US009676198B2

(12) United States Patent
Hirata et al.

(10) Patent No.: US 9,676,198 B2
(45) Date of Patent: Jun. 13, 2017

(54) RECORDING APPARATUS FOR EJECTING LIQUID INCLUDING A MAIN TANK AND A SUB TANK STORING LIQUID SUPPLIED FROM THE MAIN TANK

(71) Applicant: BROTHER KOGYO KABUSHIKI KAISHA, Nagoya-shi, Aichi-ken (JP)

(72) Inventors: Kenichi Hirata, Nagoya (JP); Motohiro Tsuboi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/973,351

(22) Filed: Dec. 17, 2015

(65) Prior Publication Data

US 2016/0185122 A1 Jun. 30, 2016

(30) Foreign Application Priority Data

Dec. 26, 2014 (JP) ..... 2014-265499
Dec. 26, 2014 (JP) ..... 2014-265500
Dec. 26, 2014 (JP) ..... 2014-265501

(51) Int. Cl.
*B41J 2/175* (2006.01)
*B41J 29/02* (2006.01)
(Continued)

(52) U.S. Cl.
CPC ..... *B41J 2/175* (2013.01); *B41J 2/17566* (2013.01); *B41J 2/17596* (2013.01); *B41J 29/02* (2013.01); *B41J 29/13* (2013.01); *B41J 29/38* (2013.01)

(58) Field of Classification Search
CPC ..... B41J 2/175
See application file for complete search history.

(56) References Cited

U.S. PATENT DOCUMENTS 4,893,137 A * 1/1990 Ebinuma ..... B41J 2/1652 346/134
2003/0218651 A1* 11/2003 Fukano ..... B41J 2/17566 347/19

(Continued)

FOREIGN PATENT DOCUMENTS

JP 63-145070 A 6/1988
JP 2003-103769 A 4/2003

(Continued)

*Primary Examiner* — Bradley Thies
(74) *Attorney, Agent, or Firm* — Merchant & Gould P.C.

(57) ABSTRACT

A recording apparatus comprising a container to store a sheet of recording medium; a conveyer configured to convey the recording medium in the container; a main tank receiving portion configured to receive a main tank for storing liquid; a sub tank configured to store liquid supplied from the main tank; and a recording head including an ejection surface where ejection openings for ejecting liquid supplied from the sub tank are formed. Each of three projected areas which are an area of the main tank receiving portion, an area of the sub tank, and an area of the recording head, each projected to a virtual plane parallel to a surface of the recording medium contained in the container from a first direction orthogonal to the virtual plane, at least partially overlaps a container projected area which is an area of the container projected to the virtual plane from the first direction.

15 Claims, 13 Drawing Sheets

(51) Int. Cl.
*B41J 29/13* (2006.01)
*B41J 29/38* (2006.01)

(56) References Cited

U.S. PATENT DOCUMENTS

2012/0249629 A1* 10/2012 Yabuki ..... B41J 2/1752
347/6
2013/0083100 A1* 4/2013 Yabuki ..... B41J 2/17509
347/7
2013/0106965 A1* 5/2013 Yamamoto ..... B41J 29/13
347/86
2013/0221127 A1* 8/2013 Tamaki ..... B41J 2/16585
239/124
2014/0092179 A1* 4/2014 Tamaki ..... B41J 2/17509
347/85

FOREIGN PATENT DOCUMENTS

JP 2004-306340 A 11/2004
JP 2005-81546 A 3/2005
JP 2005-88209 A 4/2005
JP 2013-116629 A 6/2013

* cited by examiner

RECORDING APPARATUS FOR EJECTING LIQUID INCLUDING A MAIN TANK AND A SUB TANK STORING LIQUID SUPPLIED FROM THE MAIN TANK

CROSS REFERENCE TO RELATED APPLICATION

This application claims priority from Japanese Patent Applications No. 2014-265499, No. 2014-265500 and No. 2014-265501 which were filed on Dec. 26, 2014, the disclosure of which is herein incorporated by reference in its entirety.

BACKGROUND OF THE INVENTION

1 Field of the Invention

The present invention relates to a recording apparatus such as an inkjet printer.

2 Description of Related Art

There has been known a recording apparatus including a sheet supplier, a registration adjuster, a recording unit, and a sheet discharger which are positioned adjacent to one another in a horizontal direction. The sheet supplier includes: a container configured to contain a sheet of recording medium; and a conveyer configured to convey the recording medium contained in the container. The recording unit includes a recording head and a sub tank. The sub tank stores liquid supplied from a main tank. The liquid supplied from the sub tank to the recording head is ejected from ejection openings formed on an ejection surface of the recording head.

SUMMARY OF THE INVENTION

The main tank is positioned lower than the sub tank. Each of the main tank, the sub tank, and the recording head does not overlap the container when viewed from a first direction orthogonal to a surface of the recording medium contained in the container. In the above arrangement, downsizing of the area of the apparatus viewed from the first direction is not achieved.

An object of the present invention is to provide a recording apparatus which enables downsizing of the area of the apparatus viewed from the first direction.

A recording apparatus according to an aspect of the invention comprises: a container configured to store a sheet of recording medium; a conveyer configured to convey the recording medium contained in the container; a main tank receiving portion configured to receive a main tank for storing liquid; a sub tank configured to store liquid supplied from the main tank; and a recording head including an ejection surface where ejection openings for ejecting liquid supplied from the sub tank are formed. Each of three projected areas which are an area of the main tank receiving portion, an area of the sub tank, and an area of the recording head, each projected to a virtual plane parallel to a surface of the recording medium contained in the container from a first direction orthogonal to the virtual plane, at least partially overlaps a container projected area which is an area of the container projected to the virtual plane from the first direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe preferred embodiments of the present invention, with reference to the drawings.

As shown in FIG. 1 to FIG. 4, an inkjet printer 1 of the first embodiment of the present invention includes a first casing 1*a* and a second casing 1*b* each having a rectangular parallelepiped shape. The first casing 1*a* has an open bottom, while the second casing 1*b* has an open top. The first casing 1*a* is stacked on the second casing 1*b* so that the open bottom of the first casing 1*a* is closed by the second casing 1*b* while the open top of the second casing 1*b* is closed by the first casing 1*a*. With this, an internal space of the printer 1 is defined.

The first casing 1*a* is provided with a pair of rotation shafts 1*x* each extending in the second direction. The pair of rotation shafts 1*x* are spaced apart from each other in the second direction. The second casing 1*b* is provided with a not-illustrated bearing which rotatably supports the pair of rotation shafts 1*x*. The pair of rotation shafts 1*x* function as a supporter which supports the first casing 1*a* movably relative to the second casing 1*b*. Further, the pair of rotation shafts 1*x* function as a shaft member having an axis 1*x*1 along the second direction. The first casing 1*a* is configured to be rotated about the axis 1*x*1 while being supported by the rotation shaft 1*x*, and thus the first casing 1*a* is movable relative to the second casing 1*b*. This enables the first casing 1*a* to take a first position shown in FIG. 1 and FIG. 2, and a second position shown in FIG. 3 and FIG. 4. When the first casing 1*a* is in the first position, the first casing 1*a* closes the open top of the second casing 1*b* and the second casing 1*b* closes the open bottom of the first casing 1*a*. When the first casing 1*a* is in the second position, the internal space of the printer 1 is accessible by a user through an opening formed between the first casing 1*a* and the second casing 1*b*.

Figure 5:
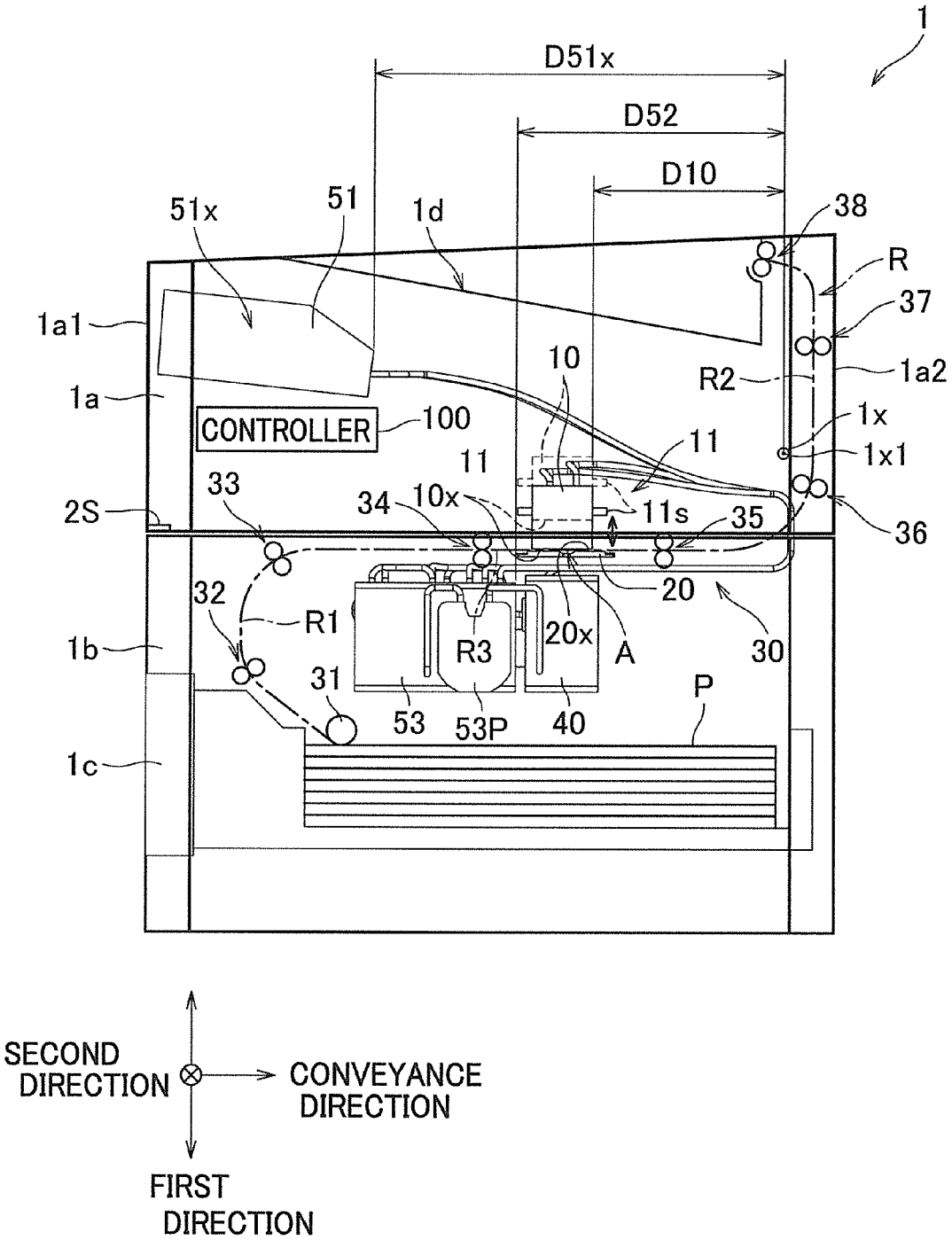
FIG. 5 is a side view of the inkjet printer of the first embodiment of the present invention, illustrating the state where the first casing is in the first position.

As shown in FIG. 1 to FIG. 4, in the internal space of the printer 1, there are positioned a container 1*c*, a recording head 10, a platen 20, a main tank receiving portion 51*x*, an ejected liquid receiving member 40, a sub tank 52, an ejected liquid tank 53, a moisturizing liquid tank 54, pumps 51P1, 51P2, 52P, 53P, and 54P, and the like. In the internal space of the printer 1, a conveyer 30 and a controller 100 are also positioned, as shown in FIG. 5. A receiver 1*d* is positioned on the top of the printer 1. The receiver 1*d* has a support surface configured to support one or more sheets of paper P. The support surface is inclined upward toward a side surface 1*a*1 of the first casing 1*a* so that the end of the support surface closer to the side surface 1*a*1 of the first casing 1*a* is higher than the end of the support surface closer to the side surface 1*a*2 of the first casing 1*a*.

The controller 100 includes a CPU (Central Processing Unit), a ROM (Read Only Memory), a RAM (Random Access Memory, including a non-volatile RAM), an ASIC (Application Specific Integrated Circuit), an I/F (Interface), an I/O (Input/Output Port), and the like. The ROM stores therein programs executed by the CPU, various fixed data, and the like. The RAM temporarily stores therein data needed at the time of execution of a program. The ASIC conducts rewriting, sorting, or the like of image data, such as signal processing and image processing. The I/F transmits/receives data to/from an external device, such as a PC connected to the printer 1. The I/O inputs/outputs detection signals of various sensors.

The container 1*c* is a box with an open top, configured to contain a plurality of sheets of paper P. The container 1*c* is attachable to/detachable from the second casing 1*b*. The first casing 1*a* has an opening opened through the side surface 1*a*1. Through the opening, the container 1*c* is attached/detached. The direction in which the container 1*c* is attached/detached is parallel to a conveyance direction which will be described later.

The recording head 10 is a line-type inkjet head long in the second direction. The recording head 10 includes an ejection surface 10*x* where a plurality of ejection openings from which ink is ejected are formed. From the ejection openings, ink supplied from the sub tank 52 is ejected. The recording head 10 is supported by the first casing 1*a*, and is positioned higher than the container 1*c*.

As shown in FIG. 5, the recording head 10 is configured to be movable by a head raising/lowering mechanism 11, within a predetermined range, in a first direction orthogonal to the ejection surface 10*x*. The head raising/lowering mechanism 11 corresponds to a "moving mechanism" in the present invention. The head raising/lowering mechanism 11 includes: a frame 11*s* supporting the recording head 10; and a head raising/lowering motor 11M (see FIG. 8). As the head raising/lowering motor 11M is driven under the control of the controller 100, the frame 11*s* is raised or lowered while supporting the recording head 10, with the result that the position of the ejection surface 10*x* in the first direction changes. For example, the recording head 10 is in a recording position indicated with a solid line in FIG. 5 during recording. Meanwhile, the recording head 10 is in a wiping position indicated with a broken line in FIG. 5, during wiping of the ejection surface 10*x*. The recording position is lower than the wiping position, and is the lowest position within the predetermined range.

The platen 20 is supported by the second casing 1*b*. The platen 20 is positioned higher than the container 1*c* and lower than the recording head 10. The platen 20 corresponds to an "opposing member" in the present invention. The platen 20 includes two plates 20*a* and 20*b*. The plates 20*a* and 20*b* are configured to be rotatable about their respective axes along the second direction. The axes are respectively positioned at edges of the plates 20*a* and 20*b*, which edges are respectively on the other side of the plates 20*a* and 20*b* from opposing edges of the plates 20*a* and 20*b* opposing each other in the conveyance direction. The plates 20*a* and 20*b* are rotated by a platen rotating motor 20M (see FIG. 8) under the control of the controller 100. This enables the platen 20 to take an opposing surface forming position (see FIG. 1 to FIG. 5) and an open position, which is not illustrated. In the opposing surface forming position, the opposing edges of the plates 20*a* and 20*b* are brought into contact with each other, and the surfaces of the plates 20*a* and 20*b* form an opposing surface 20*x*. The opposing surface 20*x* is configured to support a sheet of paper P in an opposing position A where the paper P opposes the ejection surface 10*x*. In the open position, the opposing edges of the plates 20*a* and 20*b* are separated from each other, and the ejection surface 10*x* opposes the ejected liquid receiving member 40 in the first direction across a space between the plates 20*a* and 20*b* created as a result of separation of the opposing edges of the plates 20*a* and 20*b*. The platen 20 is in the opposing surface forming position during recording. Meanwhile, the platen 20 is in the open position during purging. Purging is the process of forcing ink from the sub tank 52 to ink passages of the recording head 10, to forcibly discharge the ink through all the ejection openings.

In the situation where the first casing 1*a* is in the first position, there is a predetermined gap between the ejection surface 10*x* and the opposing surface 20*x*. In the situation where the first casing 1*a* is in the second position, the distance between the ejection surface 10*x* and the opposing surface 20*x* is larger than that in the situation where the first casing 1*a* is in the first position. In the first position, recording is performed by the recording head 10. In the second position, a process of clearing a paper jam or the like is performed.

The conveyer 30 includes a pickup roller 31 and pairs of rollers 32 to 38.

The pickup roller 31 is positioned to contact the uppermost sheet of paper P in the container 1*c*. The pickup roller 31 is rotated by a pickup motor 1*c*M (see FIG. 8) driven under the control of the controller 100. As the pickup roller 31 is rotated, the uppermost sheet of paper Pin the container 1c is forwarded from the container 1c.

Each pair of the pairs of rollers 32 to 38 includes two rollers contacting each other. Each pair of rollers (32 to 38) are configured to convey a sheet of paper P while holding the paper P between the two rollers. One of the two rollers included in each pair of rollers (32 to 38) is a driving roller, which is rotated by a conveyor motor 30M (see FIG. 8) driven under the control of the controller 100. The other of the two rollers included in each pair of rollers (32 to 38) is a driven roller, which rotates with the rotation of the driving roller. The driven roller rotates in the direction opposite to the rotation direction of the driving roller, while contacting the driving roller.

Each sheet of paper P contained in the container 1c is forwarded by the pickup roller 31 from the container 1c. Then, the paper P is conveyed along a conveyance path R by means of the rotation of the pairs of rollers 32 to 38, toward the receiver 1d via the opposing position A. Note that the "conveyance direction" is the direction in which the paper P conveyed by the conveyer 30 is conveyed when the paper P passes through the opposing position A. The conveyance direction is parallel to the horizontal direction and orthogonal to the second direction. The conveyance path R is formed into an S-like shape, and includes a first curvature R1, a second curvature R2, and a straight portion R3. The first curvature R1 extends from the container 1c to the opposing position A, and is convex upstream in the conveyance direction. The second curvature R2 extends from the opposing position A to the receiver 1d, and is convex downstream in the conveyance direction. The straight portion R3 extends along the conveyance direction.

The receiver 1d is configured to receive the paper P conveyed by the conveyer 30 and having passed through the opposing position A. The receiver 1d is positioned on a top plate of the first casing 1a.

The main tank receiving portion 51x is configured to receive a main tank 51 for storing ink and moisturizing liquid. The main tank receiving portion 51x is positioned in the first casing 1a. The main tank receiving portion 51x is positioned higher than the recording head 10, and the main tank receiving portion 51x overlaps the recording head 10 in the second direction. In this embodiment, the both ends of the main tank receiving portion 51x in the second direction respectively aligned with the both ends of the recording head 10 in the second direction, in the plan view of FIG. 6. Thus, the main tank receiving portion 51x substantially completely overlaps the recording head 10 in the second direction. Further, the position of the center of the first casing 1a in the second direction, the position of the center of the recording head 10 in the second direction, the position of the center of the main tank receiving portion 51x in the second direction match one another. The moisturizing liquid may be pure water, water with a preservative, or the like.

The main tank receiving portion 51x is configured to receive the main tank 51 through an opening 1e opened through the side surface 1a1 of the first casing 1a. Specifically, a door 1ex is openably/closably attached to a portion of the side surface 1a1 which defines the opening 1e. It is possible for a user to attach/detach the main tank 51 to/from the main tank receiving portion 51x by opening the door 1ex. The side surface 1a1 is one of four side surfaces of the first casing 1a which cross the ejection surface 10x. In other words, out of the four side surfaces, the side surface 1a1 is one of two side surfaces of the first casing 1a which are parallel to the axis 1x1 and oppose each other in the conveyance direction in the situation where the first casing 1a is in the first position. In the situation where the first casing 1a is in the first position, the distance between the side surface 1a1 and the axis 1x1 in the conveyance direction is larger than the distance between the side surface 1a2, which is the other side surface of the above two side surfaces, and the axis 1x1 in the conveyance direction.

The ejected liquid receiving member 40 is a member of a box-like shape configured to receive ink ejected from the ejection openings of the recording head 10 during purging. The ejected liquid receiving member 40 opposes the recording head 10 with the platen 20 interposed therebetween. During purging, the platen 20 is positioned in the open position, and the ejection surface 10x faces the ejected liquid receiving member 40 in the first direction across the space between the plates 20a and 20b. In this state, ink is ejected from all the ejection openings of the recording head 10, and the ink is received by the ejected liquid receiving member 40.

The sub tank 52 is configured to store ink supplied from the main tank 51. The sub tank 52 includes an ink storage chamber 52x communicable with an atmosphere. The sub tank 52 is positioned adjacent to the ejected liquid receiving member 40 in the conveyance direction.

The ejected liquid tank 53 is configured to store ink ejected by the recording head 10. The ejected liquid tank 53 is positioned adjacent to the ejected liquid receiving member 40 in the conveyance direction, and adjacent to the sub tank 52 in the second direction. The amount of ink storable in the ejected liquid tank 53 is larger than the amount of ink storable in the sub tank 52. In other words, the capacity of the ejected liquid tank 53 is larger than the capacity of the sub tank 52. An upper surface of the ejected liquid tank 53 is substantially level with an upper surface of the sub tank 52. Meanwhile, a lower surface of the ejected liquid tank 53 is positioned lower than a lower surface of the sub tank 52. With the above configuration, the sub tank 52 is positioned close to the recording head 10 in the first direction. Further, a side surface of the ejected liquid tank 53 which is the closest to the axis 1x1 in the conveyance direction is at the same position in the conveyance direction as a side surface of the sub tank 52 which is the closest to the axis 1x1 in the conveyance direction. With this configuration, the ejected liquid tank 53 is positioned close to the ejected liquid receiving member 40 in the conveyance direction, and the sub tank 52 is positioned close to the recording head 10 in the conveyance direction.

The moisturizing liquid tank 54 is configured to store moisturizing liquid for moisturizing a space opposing the ejection surface 10x. The moisturizing liquid tank 54 is positioned on the opposite side from the ejected liquid receiving member 40 so that the sub tank 52 is interposed between the moisturizing liquid tank 54 and the ejected liquid receiving member 40.

The ejected liquid receiving member 40, the sub tank 52, the ejected liquid tank 53, and the moisturizing liquid tank 54 are supported by the second casing 1b, and these members are positioned higher than the container 1c and lower than the recording head 10 and the platen 20. The sub tank 52 and the ejected liquid tank 53 are positioned side by side in the second direction. Further, each of the sub tank 52 and the ejected liquid tank 53 is positioned side by side with the platen 20 and the ejected liquid receiving member 40 in the conveyance direction.

The pump 51P1 is provided to a communicating tube 51t1 through which the main tank 51 communicates with the sub tank 52. The pump 51P1 corresponds to a "liquid supplier" in the present invention. When the pump 51P1 is turned on under the control of the controller 100, ink is supplied from the main tank 51 to the sub tank 52.

The pump 51P2 is provided to a communicating tube 51*t*2 through which the main tank 51 communicates with the moisturizing liquid tank 54. When the pump 51P2 is turned on under the control of the controller 100, moisturizing liquid is supplied from the main tank 51 to the moisturizing liquid tank 54.

The pump 52P is provided to a communicating tube 52*t*1 through which the sub tank 52 communicates with the ink passages of the recording head 10. When the pump 52P is turned on under the control of the controller 100, ink is supplied from the sub tank 52 to the ink passages of the recording head 10.

The pump 53P is provided to a communicating tube 53*t* through which the ejected liquid tank 53 communicates with the ejected liquid receiving member 40. When the pump 53P is turned on under the control of the controller 100, ink is supplied from the ejected liquid receiving member 40 to the ejected liquid tank 53.

The pump 54P is provided to a communicating tube 54*t*1 through which the moisturizing liquid tank 54 communicates with the space opposing the ejection surface 10*x* of the recording head 10. When the pump 54P is turned on under the control of the controller 100, air in the moisturizing liquid tank 54 is supplied to the space opposing the ejection surface 10*x*.

The pumps 51P1, 51P2, 52P, 53P, and 54P are supported by the second casing 1*b*.

The sub tank 52 communicates with the ink passages of the recording head 10 through two communicating tubes: the communicating tube 52*t*1 to which the pump 52P is provided; and a communicating tube 52*t*2 to which a not-illustrated valve is provided. The controller 100 controls opening/closing of the valve and driving of the pump 52P. With this control, the flow of ink between the sub tank 52 and the ink passages of the recording head 10 is controlled during recording, purging, and circulation purging. Circulation purging is the process of circulating ink between the sub tank 52 and the ink passages of the recording head 10 to discharge ink with foreign matter, such as air bubbles accumulated in the ink passages of the recording head 10, to the sub tank 52.

The moisturizing liquid tank 54 communicates with the space opposing the ejection surface 10*x* of the recording head 10 through two communicating tubes: the communicating tube 54*t*1 to which the pump 54P is provided; and a communicating tube 54*t*2 to which a not-illustrated buffer tank is provided. The buffer tank is configured to receive moisturizing liquid stored in the moisturizing liquid tank 54 before the moisturizing liquid flows into the recording head 10 when the printer 1 is overturned, for example, to prevent the moisturizing liquid from flowing into the recording head 10.

The communicating tube 52*t*1 extends from a portion of the sub tank 52 which is on the other side of the sub tank 52 from an opposing portion of the sub tank 52 opposing the ejected liquid tank 53 in the second direction. That is, the communicating tube 52*t*1 extends from a portion of the sub tank 52 which is closer to a viewer of FIG. 1. The communicating tube 53*t* extends from a portion of the ejected liquid tank 53 which is on the other side of the ejected liquid tank 53 from an opposing portion of the ejected liquid tank 53 opposing the sub tank 52 in the second direction. That is, the communicating tube 53*t* extends from a portion of the ejected liquid tank 53 which is farther from the viewer of FIG. 1.

Now, with reference to FIG. 6, description will be given for the positional relationship among the components of the printer 1 as seen from the first direction. Note that the first direction is a direction orthogonal to a virtual plane parallel to the surfaces of one or more sheets of paper P contained in the container 1*c*. Hereinafter, this virtual plane is simply referred to as the virtual plane.

Reference is made to: a main tank receiving portion projected area 51*x*A which is the area of the main tank receiving portion 51*x* projected onto the virtual plane from the first direction; a sub tank projected area 52A which is the area of the sub tank 52 projected onto the virtual plane from the first direction; and a recording head projected area 10A which is the area of the recording head 10 projected onto the virtual plane from the first direction. Each of these projected areas 51*x*A, 52A, and 10A at least partially overlaps a container projected area 1*c*A which is the area of the container 1*c* projected onto the virtual plane from the first direction. In this embodiment, each of the three projected areas 51*x*A, 52A, and 10A substantially entirely overlaps the container projected area 1*c*A, and each of the three projected areas 51*x*A, 52A, and 10A is within the container projected area 1*c*A. The three projected areas 51*x*A, 52A, and 10A and the container projected area 1*c*A each at least partially overlaps a receiver projected area 1*d*A which is the area of the receiver 1*d* projected onto the virtual plane from the first direction. In this embodiment, an approximately half of the main tank receiving portion projected area 51*x*A overlaps the receiver projected area 1*d*A. Approximately the whole of the sub tank projected area 52A overlaps the receiver projected area 1*d*A. Approximately the whole of the recording head projected area 10A overlaps the receiver projected area 1*d*A. Further, the receiver projected area 1*d*A substantially entirely overlaps the container projected area 1*c*A, and the receiver projected area 1*d*A is within the container projected area 1*c*A. An ejected liquid tank projected area 53A which is the area of the ejected liquid tank 53 projected onto the virtual plane from the first direction at least partially overlaps the container projected area 1*c*A. In this embodiment, the ejected liquid tank projected area 53A substantially entirely overlaps the container projected area 1*c*A, and the ejected liquid tank projected area 53A is within the container projected area 1*c*A. A moisturizing liquid tank projected area 54A which is the area of the moisturizing liquid tank 54 projected onto the virtual plane from the first direction, and a moisturizing pump projected area 54PA which is the area of the pump 54P projected onto the virtual plane from the first direction, each at least partially overlaps the container projected area 1*c*A. In this embodiment, each of the moisturizing liquid tank projected area 54A and the moisturizing pump projected area 54PA substantially entirely overlaps the container projected area 1*c*A, and is within the container projected area 1*c*A.

Figure 6:
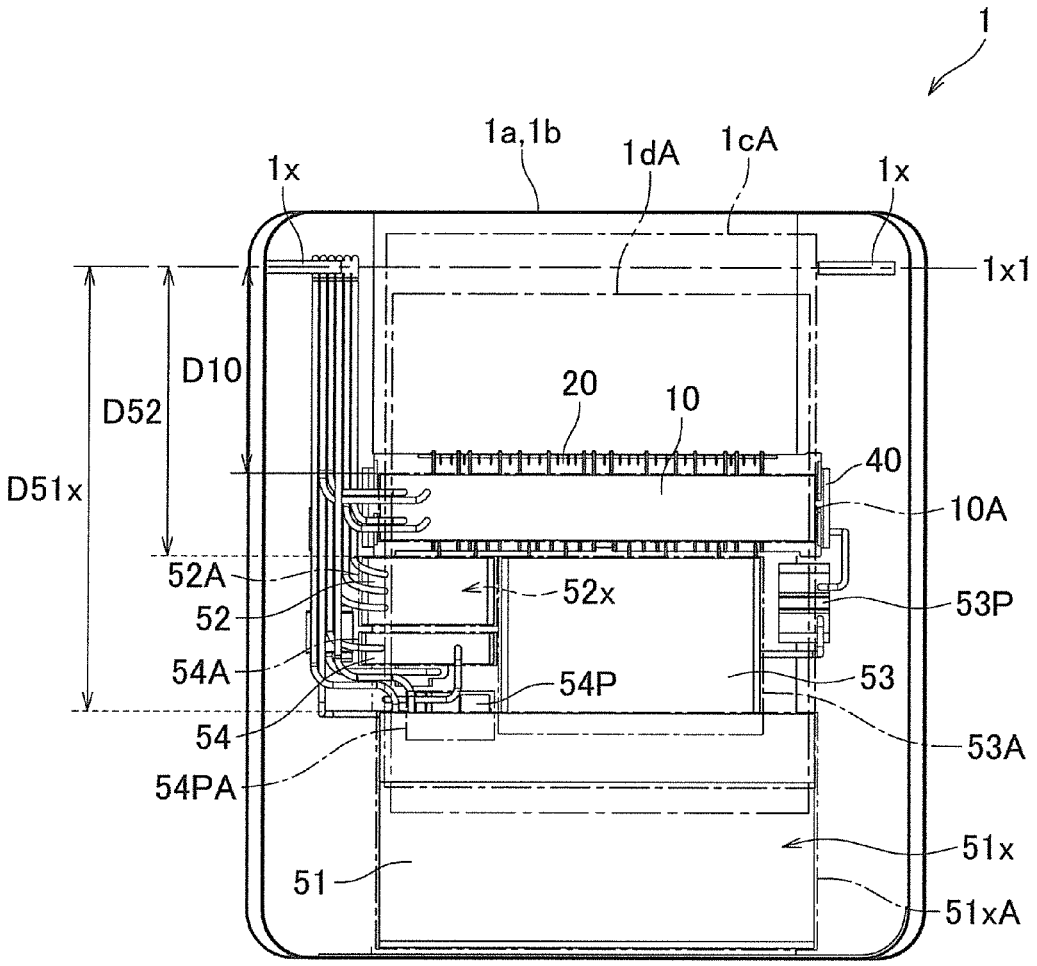
FIG. 6 is a plan view of the inkjet printer of the first embodiment of the present invention, illustrating the state where the first casing is in the first position.
Figure 6:
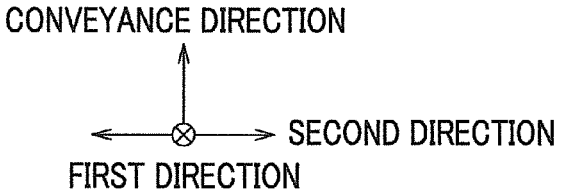

As shown in FIG. 5 and FIG. 6, in the situation where the first casing 1*a* is in the first position, a distance D10 between the recording head 10 and the axis 1*x*1 in the conveyance direction is smaller than a distance D51*x* between the main tank receiving portion 51*x* and the axis 1*x*1, and than a distance D52 between the sub tank 52 and the axis 1*x*1. The distance D52 is smaller than the distance D51*x*. That is, the relationship of D10<D52<D51*x* is satisfied.

Figure 8:
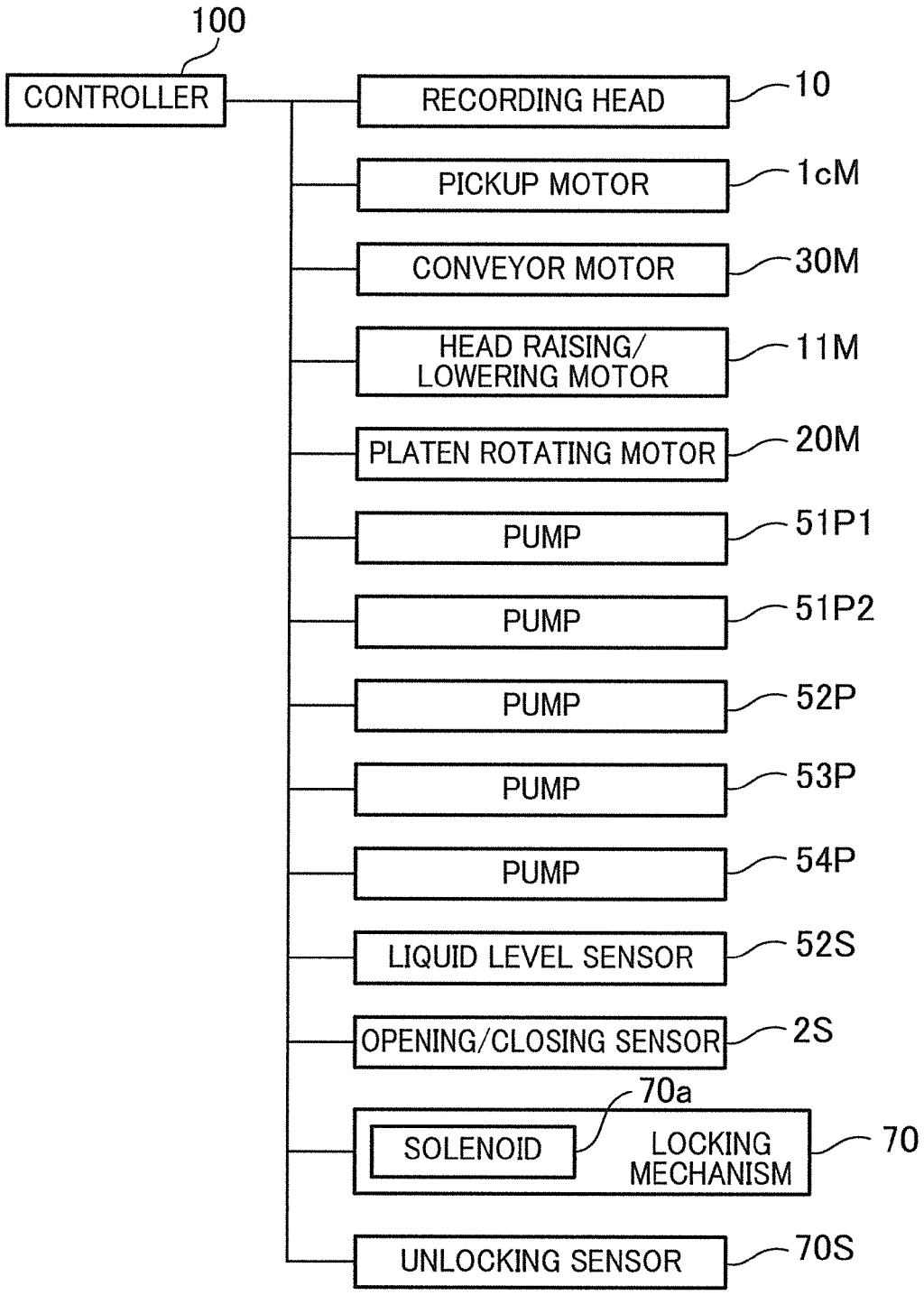
FIG. 8 is a block diagram illustrating an electrical configuration of the inkjet printer of the first embodiment of the present invention.

The printer 1 further includes: a liquid level sensor 52S; an opening/closing sensor 2S; a locking mechanism 70 including a solenoid 70*a*; and an unlocking sensor 70S, as shown in FIG. 8.

The liquid level sensor 52S is provided to the sub tank 52. The liquid level sensor 52S is configured to output an OFF signal when the amount of ink stored in the sub tank 52 is less than a predetermined amount, and to output an ON signal (second signal) when the amount of ink stored in the sub tank 52 is equal to or more than the predetermined amount. The liquid level sensor 52S corresponds to a "second signal output unit" in the present invention.

The opening/closing sensor 2S is positioned on a lower portion of the side surface 1*a*1 of the first casing 1*a*, i.e., a portion of the first casing 1*a* which defines the open bottom of the first casing 1*a*. The opening/closing sensor 2S is configured to output an OFF signal when the first casing 1*a* is in the first position, and to output an ON signal when movement of the first casing 1*a* from the first position to the second position is started.

The locking mechanism 70 is configured to selectively allow and forbid the movement of the first casing 1*a* from the first position to the second position. The locking mechanism 70 is positioned on a side surface of the first casing 1*a*, for example, a portion of the side surface 1*a*1 which is below the opening 1*e*.

Figure 7A:
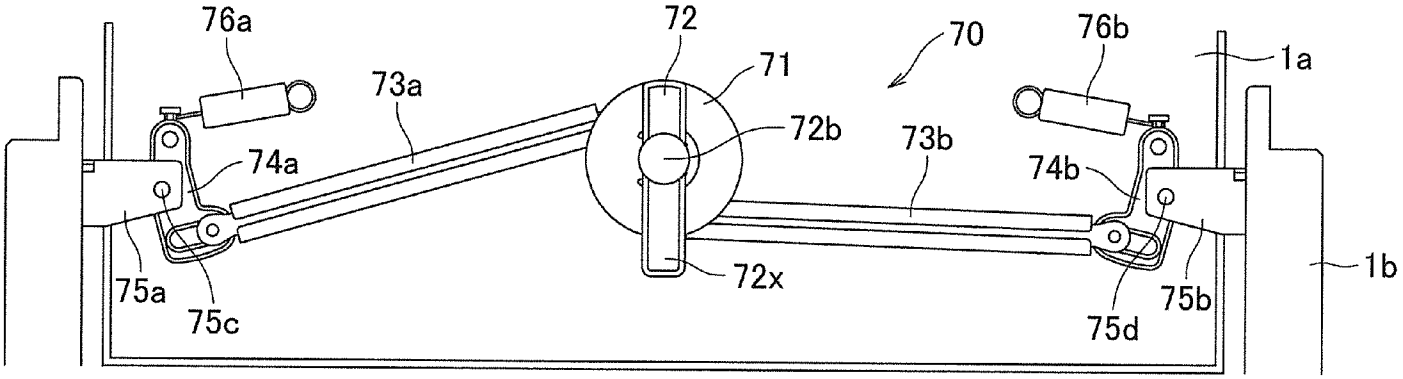
FIG. 7A is a front view of a locking mechanism positioned in the inkjet printer of the first embodiment of the present invention, illustrating the state where the movement of the first casing from the first position to the second position is forbidden.
Figure 7B:
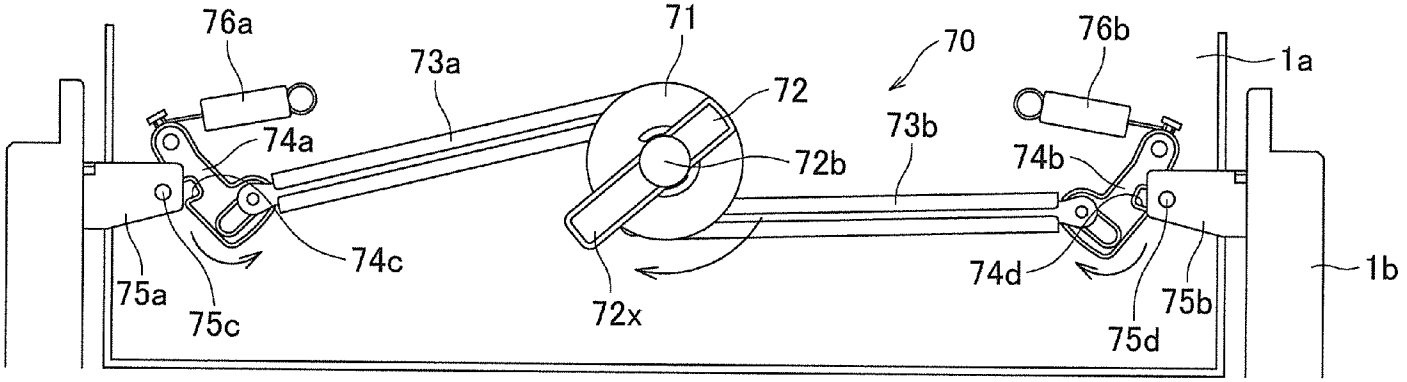
FIG. 7B is a front view of the locking mechanism positioned in the inkjet printer of the first embodiment of the present invention, illustrating the state where the movement of the first casing from the first position to the second position is allowed.

As shown in FIG. 7A and FIG. 7B, the locking mechanism 70 includes a cylindrical rotating member 71, interlocking members 73*a* and 73*b*, swinging members 74*a* and 74*b*, springs 76*a* and 76*b*, and fixing members 75*a* and 75*b*, in addition to the solenoid 70*a* (see FIG. 8). One end of each of the interlocking members 73*a* and 73*b* in its longitudinal direction is coupled to a peripheral surface of the rotating member 71. The swinging members 74*a* and 74*b* respectively have recesses 74*c* and 74*d* each of which opens toward a direction away from the rotating member 71. The fixing members 75*a* and 75*b* are respectively provided with shaft members 75*c* and 75*d* insertable into the corresponding recesses 74*c* and 74*d*. Swing axes of the swinging members 74*a* and 74*b* are fixed to the first casing 1*a*. An end of each of the springs 76*a* and 76*b* which is closer to the rotating member 71 is fixed to the first casing 1*a*. The fixing members 75*a* and 75*b* are fixed to the second casing 1*b*.

On a front surface of the rotating member 71, there is provided a rod-like knob 72 configured to rotate together with the rotating member 71. The springs 76*a* and 76*b* respectively bias upper ends of the swinging members 74*a* and 74*b* toward the rotating member 71. With this arrangement, the components of the locking mechanism 70 are stationary with the knob 72 extending in the first direction as shown in FIG. 7A, in the situation where no external force is applied.

In the situation shown in FIG. 7A, the recesses 74*c* and 74*d* are respectively engaged with the shaft members 75*c* and 75*d*. This engagement forbids the movement of the first casing 1*a* from the first position to the second position. When a user rotates the knob 72 clockwise against the biasing force of the springs 76*a* and 76*b*, the recesses 74*c* and 74*d* are disengaged from the shaft members 75*c* and 75*d*, as shown in FIG. 7B. This allows the movement of the first casing 1*a* from the first position to the second position. When the first casing 1*a* is returned from the second position to the first position, the recesses 74*c* and 74*d* are respectively engaged again with the shaft members 75*c* and 75*d*. As a result, the movement of the first casing 1*a* from the first position to the second position is forbidden again.

The solenoid 70*a* is configured to be engageable in a not-illustrated recess formed on a back surface of the rotating member 71. The solenoid 70*a* is capable of taking a rotation forbidding position and a rotation allowing position under the control of the controller 100. In the rotation forbidding position, the solenoid 70*a* is engaged in the recess to forbid the rotation of the rotating member 71. In the rotation allowing position, the solenoid 70*a* is released from the recess to allow the rotation of the rotating member 71. The solenoid 70*a* is usually held in the rotation forbidding position, except the case where the solenoid 70*a* is controlled to take the rotation allowing position in a control routine which will be described later.

The unlocking sensor 70S is incorporated in a button 72*b* positioned at the center of the rotation of the knob 72. The unlocking sensor 70S is configured to output an OFF signal when the button 72*b* is not pressed, and to output an ON signal (first signal) when the button 72*b* is pressed. The unlocking sensor 70S corresponding to a "first signal output unit" in the present invention. The ON signal indicates that the above movement forbidden by the locking mechanism 70 will be allowed, that is, a predetermined condition is satisfied before the movement of the first casing 1*a* from the first position to the second position is started.

Figure 9:
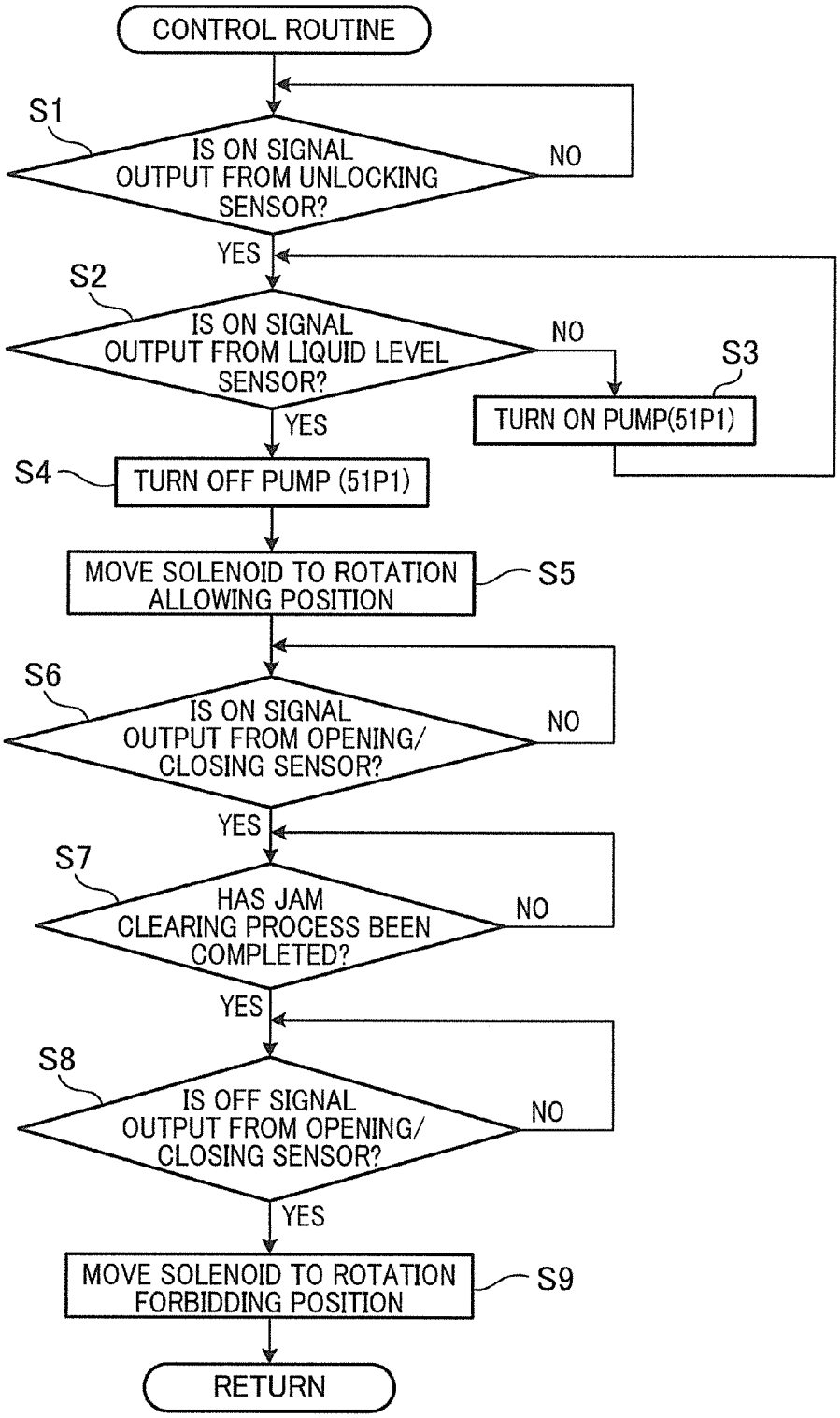
FIG. 9 is a flowchart illustrating a control routine in the inkjet printer of the first embodiment of the present invention.

The following will describe the control routine related to opening/closing of the casings 1*a* and 1*b*, with reference to FIG. 9. This control routine is repeatedly executed by the controller 100 while the printer 1 is powered on. At the start of the control routine, the solenoid 70*a* is in the rotation forbidding position.

First, the controller 100 determines whether the unlocking sensor 70S outputs an ON signal, i.e., whether a user presses the button 72*b* (S1). When the controller 100 determines that the unlocking sensor 70S does not output an ON signal (S1: NO), the controller 100 repeats the process of S1. When the controller 100 determines that the unlocking sensor 70S outputs an ON signal (S1: YES), the controller 100 determines whether the liquid level sensor 52S outputs an ON signal, i.e., whether the amount of ink stored in the sub tank 52 is equal to or more than the predetermined amount (S2).

When the controller 100 determines that the liquid level sensor 52S does not output an ON signal (S2: NO), the controller 100 turns on the pump 51P1 into an on-state when the pump 51P1 is in an off-state, or keeps the pump 51P1 in the on-state when the pump 51P1 is in the on-state (S3). With the pump 51P1 in the on-state, ink is supplied to the sub tank 52 to the main tank 51. After S3, the controller 100 returns the processing back to S2. When the controller 100 determines that the liquid level sensor 52S outputs an ON signal (S2: YES), the controller 100 turns off the pump 51P1 from the on-state to the off-state (S4).

After S4, the controller 100 controls the solenoid 70*a* so as to take the rotation allowing position (S5). With this, the solenoid 70*a* moves from the rotation forbidding position to the rotation allowing position, to allow the rotation of the rotating member 71. This state enables a user to rotate the knob 72 to move the first casing 1*a* from the first position to the second position.

After S5, the controller 100 determines whether the opening/closing sensor 2S outputs an ON signal, i.e., whether the movement of the first casing 1*a* from the first position to the second position is started (S6). When the controller 100 determines that the opening/closing sensor 2S does not output an ON signal (S6: NO), the controller 100 repeats the process of S6.

When the controller 100 determines that the opening/closing sensor 2S outputs an ON signal (S6: YES), the controller 100 determines whether a process of clearing a paper jam ("jam clearing process") has been completed (S7). For example, the controller 100 may determine that the above paper jam clearing process has been completed when the controller 100 receives, from a sensor configured to detect the presence or absence of a sheet of paper P in the opposing position A, a signal indicating the absence of such paper P. When the controller 100 determines that the jam clearing process has not been completed (S7: NO), the controller 100 repeats the process of S7.

When the controller 100 determines that the jam clearing process has been completed (S7: YES), the controller 100 determines whether the opening/closing sensor 2S outputs an OFF signal, i.e., whether the first casing 1*a* is in the first position (S8). When the controller 100 determines that the opening/closing sensor 2S does not output an OFF signal (S8: NO), the controller 100 repeats the process of S8.

When the controller 100 determines that the opening/closing sensor 2S outputs an OFF signal (S8: YES), the controller 100 controls the solenoid 70*a* so as to take the rotation forbidding position (S9). With this, the solenoid 70*a* moves from the rotation allowing position to the rotation forbidding position, to forbid the rotation of the rotating member 71. This state disables the user to rotate the knob 72 to move the first casing 1*a* from the first position to the second position. After S9, the controller 100 ends this routine.

As described above, in this embodiment, each of the main tank receiving portion projected area 51*x*A, the sub tank projected area 52A, and the recording head projected area 10A at least partially overlaps the container projected area 1*c*A (see FIG. 6). With this, downsizing of the area of the apparatus viewed from the first direction is achieved.

The three projected areas 51*x*A, 52A, and 10A, and the container projected area 1*c*A each at least partially overlaps the receiver projected area 1*d*A. In this case, downsizing of the area of the apparatus viewed from the first direction is achieved, for the apparatus including the receiver 1*d*.

The conveyance path R is formed into the S-like shape, and includes: the first curvature R1 which extends from the container 1*c* to the opposing position A and is convex upstream in the conveyance direction; the second curvature R2 which extends from the opposing position A to the receiver 1*d* and is convex downstream in the conveyance direction; and the straight portion R3 which extends along the conveyance direction (see FIG. 5). In this case, downsizing of the area of the apparatus viewed from the first direction is more effectively achieved, for the apparatus including the receiver 1*d*.

The ejected liquid tank projected area 53A at least partially overlaps the container projected area 1*c*A (see FIG. 6). In this case, downsizing of the area of the apparatus viewed from the first direction is achieved, for the apparatus including the ejected liquid tank 53.

Each of the moisturizing liquid tank projected area 54A and the moisturizing pump projected area 54PA at least partially overlaps the container projected area 1*c*A. In this case, downsizing of the area of the apparatus viewed from the first direction is achieved, for the apparatus including the moisturizing liquid tank 54 and the pump 54P.

The printer 1 includes: the first casing 1*a* supporting the recording head 10; and the second casing 1*b* supporting the sub tank 52 and the platen 20. The sub tank 52 includes the ink storage chamber 52*x* communicable with an atmosphere. The first casing 1*a* is movable relative to the second casing 1*b* so that the first casing 1*a* is capable of taking the first position and the second position where the distance between the ejection surface 10*x* and the opposing surface 20*x* is larger than that in the first position (see FIG. 1 to FIG. 4). In this case, the jam clearing process is preformed easily when a sheet of paper P is jammed between the ejection surface 10*x* and the opposing surface 20*x*, by moving the first casing 1*a* relative to the second casing 1*b* into the second position. Further, in the above configuration, it is easier to position the sub tank 52 lower than the recording head 10. By such positioning, a head difference between the ink in the recording head 10 and the ink in the sub tank 52 is made such that a suitable negative pressure is applied to menisci formed in the ejection openings of the recording head 10. In addition, the sub tank 52 is supported by the second casing 1*b*. Because of this, the weight of the first casing 1*a* is smaller than in the case where the sub tank 52 is supported by the first casing 1*a*. This makes it easier to move the first casing 1*a*. Further, because the sub tank 52 is supported by the second casing 1*b*, a lack of horizontal balance of the weight of the first casing 1*a* is less likely to occur, and the load applied to the rotation shafts 1*x* is reduced.

The main tank receiving portion 51*x* is positioned in the first casing 1*a*, and the main tank receiving portion 51*x* is configured to receive the main tank 51 through the opening 1*e* opened through the side surface 1*a*1 of the first casing 1*a*. In this case, because the opening 1*e* is formed through the side surface 1*a*1 of the first casing 1*a*, the main tank 51 is easily attached to/detached from the main tank receiving portion 51*x* through the opening 1*e*.

The ejected liquid tank 53 is supported by the second casing 1*b*. It is preferable that the ejected liquid tank 53 is positioned lower than the recording head 10 because the ejected liquid tank 53 stores ink ejected from the recording head 10. Such position of the ejected liquid tank 53 is preferable in order to keep the balance of the weight of the overall apparatus because the weight varies depending on the ink stored in the tank 53.

The first casing 1*a* moves relative to the second casing 1*b* by rotating about the axis 1*x*1 which is along the second direction. In the situation where the first casing 1*a* is in the first position, the distance D10 between the recording head 10 and the axis 1*x*1 in the conveyance direction is smaller than the distance D52 between the sub tank 52 and the axis 1*x*1 in the conveyance direction (see FIG. 5). In the configuration where the first casing 1*a* is moved relative to the second casing 1*b* by rotation, the farther the recording head 10 is positioned from the axis 1*x*1, the larger the amount of the upward movement of the recording head 10 during the rotation of the first casing 1*a* is, and thus the larger a change in the head difference between the ink in the sub tank 52 supported by the second casing 1*b* and the ink in the recording head 10 supported by the first casing 1*a* is. In the configuration of this embodiment, however, the recording head 10 is positioned relatively closer to the axis 1*x*1. This reduces the amount of upward movement of the recording head 10 during the rotation of the first casing 1*a*, and therefore reduces the change in the head difference. Further, breakage of the menisci is prevented. In addition, the main tank receiving portion 51*x* is positioned in a space made available by positioning the recording head 10 close to the axis 1*x*1. Thus, the space is effectively used.

As shown in FIG. 9, upon receiving an ON signal from the unlocking sensor 70S (S1: YES), the controller 100 controls the pump 51P1 to supply ink from the main tank 51 to the sub tank 52 until the amount of ink stored in the sub tank 52 becomes equal to or more than the predetermined amount (S2 to S4). In this case, the change in the head difference caused by the movement of the first casing 1*a* is prevented or reduced.

Upon receiving an ON signal from the unlocking sensor 70S (S1: YES), the controller 100 controls the pump 51P1 to supply ink from the main tank 51 to the sub tank 52 until the controller 100 receives an ON signal from the liquid level sensor 52S (S2: YES). In this case, the control is made by using the liquid level sensor 52S, and thereby the change in the head difference caused by the movement of the first casing 1*a* is more effectively prevented or reduced.

Upon receiving an ON signal from the unlocking sensor 70S (S1: YES), the controller 100 controls the locking mechanism 70 so that: the solenoid 70*a* is held in the rotation forbidding position; and the movement of the first casing 1*a* from the first position to the second position is forbidden until the amount of ink stored in the sub tank 52 becomes equal to or more than the predetermined amount (S2 to S5). In this case, the predetermined amount or more of ink is stored in the sub tank 52 before the movement of the first casing 1*a* is actually performed. Therefore, the change in the head difference caused by the movement of the first casing 1*a* is more reliably prevented or reduced.

The sub tank 52 is not positioned below the ejected liquid receiving member 40. Instead, the sub tank 52 is positioned side by side with the ejected liquid receiving member 40 in the conveyance direction. With this, the head difference is relatively smaller, to prevent the breakage of the menisci. Note that if the level of the ink in the sub tank 52 is positioned higher than the ejection surface 10*x* of the recording head 10, the menisci are broken. To avoid the breakage of the menisci, it is preferable to position the sub tank 52 so that the level of the ink in the sub tank 52 is lower than the ejection surface 10*x* of the recording head 10, to apply a back pressure to the ink in the recording head 10. However, if the level of the ink in the sub tank 52 is excessively lower than the ejection surface 10*x* of the recording head 10, an excessively high back pressure is applied to the ink in the recording head 10, resulting in breakage of the menisci.

The sub tank 52 is positioned side by side with the ejected liquid receiving member 40, not in the second direction, but in the conveyance direction. This suppresses an increase in the size of the printer 1 in the second direction. Further, in this embodiment, the sub tank 52 is positioned within the area of the conveyance path R in the conveyance direction (see FIG. 5). With this, an increase in the size of the printer 1 in the conveyance direction is avoided.

With the decrease in the distance between the recording head 10 and the axis 1*x*1 in the conveyance direction, the distance between the ejected liquid receiving member 40, which is positioned to oppose the recording head 10, and the axis 1*x*1 is also decreased. This makes it difficult to secure a space for providing the sub tank 52 between the ejected liquid receiving member 40 and the rotation shafts 1*x*. However, in this embodiment, the sub tank 52 is positioned farther from the axis 1*x*1 in the conveyance direction than the recording head 10. This eliminates the necessity of securing the space for the sub tank 52 between the ejected liquid receiving member 40 and the rotation shafts 1*x*. According to this embodiment, while the space for the sub tank 52 is secured, the amount of movement of the recording head 10 in the first direction during the rotation of the first casing 1*a* and thus the change in the head difference are reduced, to prevent the breakage of the menisci.

The sub tank 52 and the ejected liquid tank 53 are positioned side by side in the second direction, and each of the sub tank 52 and the ejected liquid tank 53 is positioned side by side with the platen 20 in the conveyance direction. In this case, each of the sub tank 52 and the ejected liquid tank 53 is positioned close to the recording head 10 and to the platen 20. This enables reduction of the lengths of the both of the communicating tube 52*t*1 and the communicating tube 53*t*, and such reduction prevents generation of air bubbles in each communicating tube.

Because the ejected liquid tank 53 is for storing ink received by the ejected liquid receiving member 40, it is preferable that the ejected liquid tank 53 is positioned in the vicinity of the ejected liquid receiving member 40. Now, consideration is given for the location of the ejected liquid tank 53. If the ejected liquid tank 53 is positioned side by side with the ejected liquid receiving member 40 in the second direction, it would be necessary to secure the area for the ejected liquid tank 53 in addition to the area for the ejected liquid receiving member 40 (which is nearly equal to the area for the recording head 10), with respect to the second direction. As a result, the size of the printer 1 in the second direction is possibly increased. With respect to the conveyance direction, it is necessary to secure the area for the conveyance path R; however, the increase in the size of the printer 1 in the conveyance direction is avoided if the ejected liquid receiving member 40 is positioned within the area of the conveyance path R. Next, consideration will be given for the configuration in which the ejected liquid tank 53 is positioned below the ejected liquid receiving member 40. In this configuration, the increase in the size of the printer 1 in the conveyance direction is avoided; however, it is necessary to secure a space for providing the ejected liquid tank 53 below the ejected liquid receiving member 40. This may cause an increase in the size of the printer 1 in the first direction. In view of the above, consideration will be given for the configuration in which the ejected liquid tank 53 is positioned side by side with the ejected liquid receiving member 40 in the conveyance direction. In an attempt to reduce the distance between the recording head 10 and the axis 1*x*1 in the conveyance direction in the above configuration, it is difficult to secure the space for providing the ejected liquid tank 53 between the ejected liquid receiving member 40 and the axis 1*x*1. Therefore, in this embodiment, the sub tank 52 and the ejected liquid tank 53 are positioned side by side in the second direction, and each of the sub tank 52 and the ejected liquid tank 53 is positioned side by side with the platen 20 in the conveyance direction. The above arrangement in which the ejected liquid tank 53 is positioned side by side with the sub tank 52 in the second direction suppresses the increase in the size of the printer 1 in the second direction, in the conveyance direction, and in the first direction.

Figure 1:
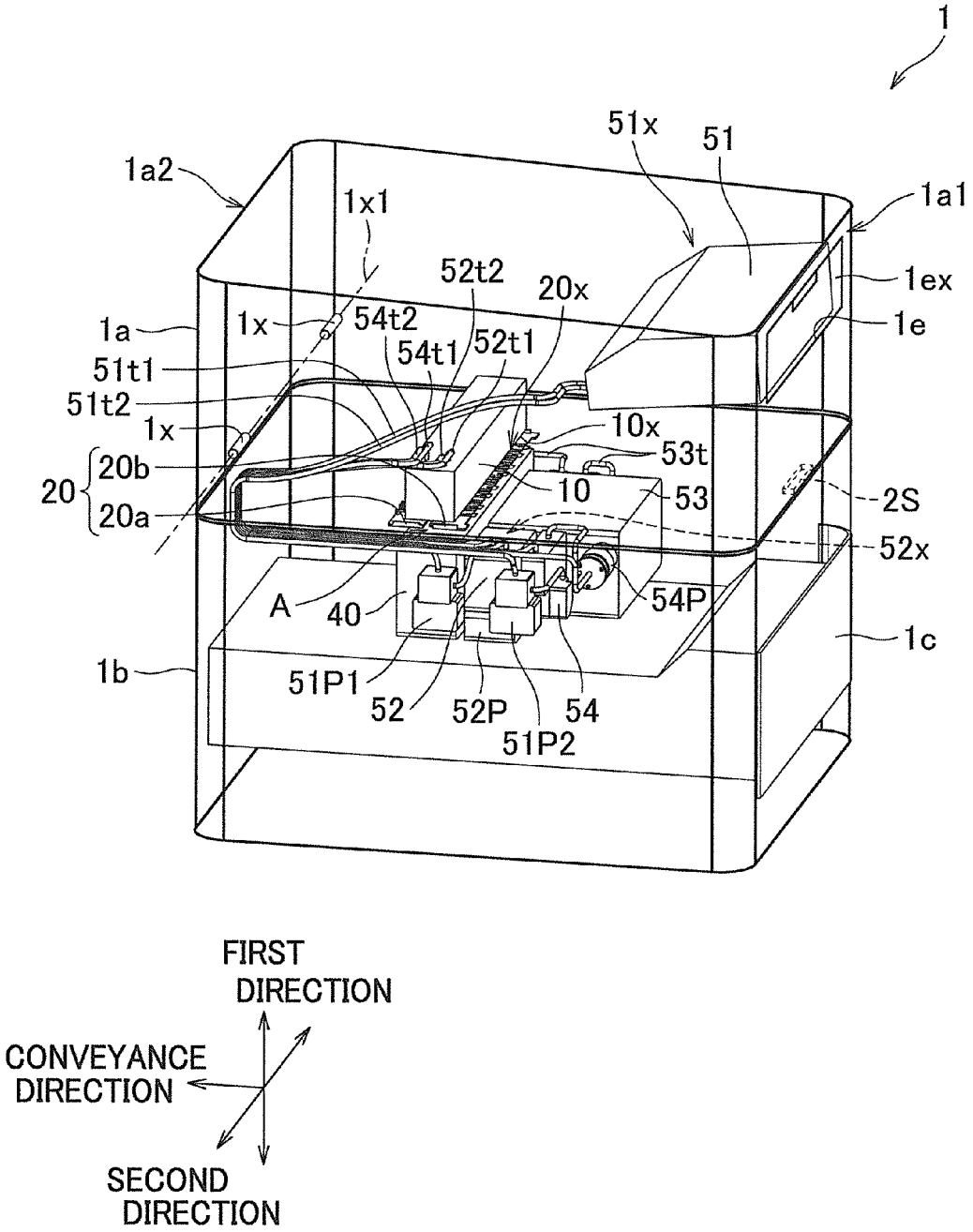
FIG. 1 is a perspective view of an inkjet printer of the first embodiment of the present invention, illustrating the state where a first casing is in a first position.
Figure 2:
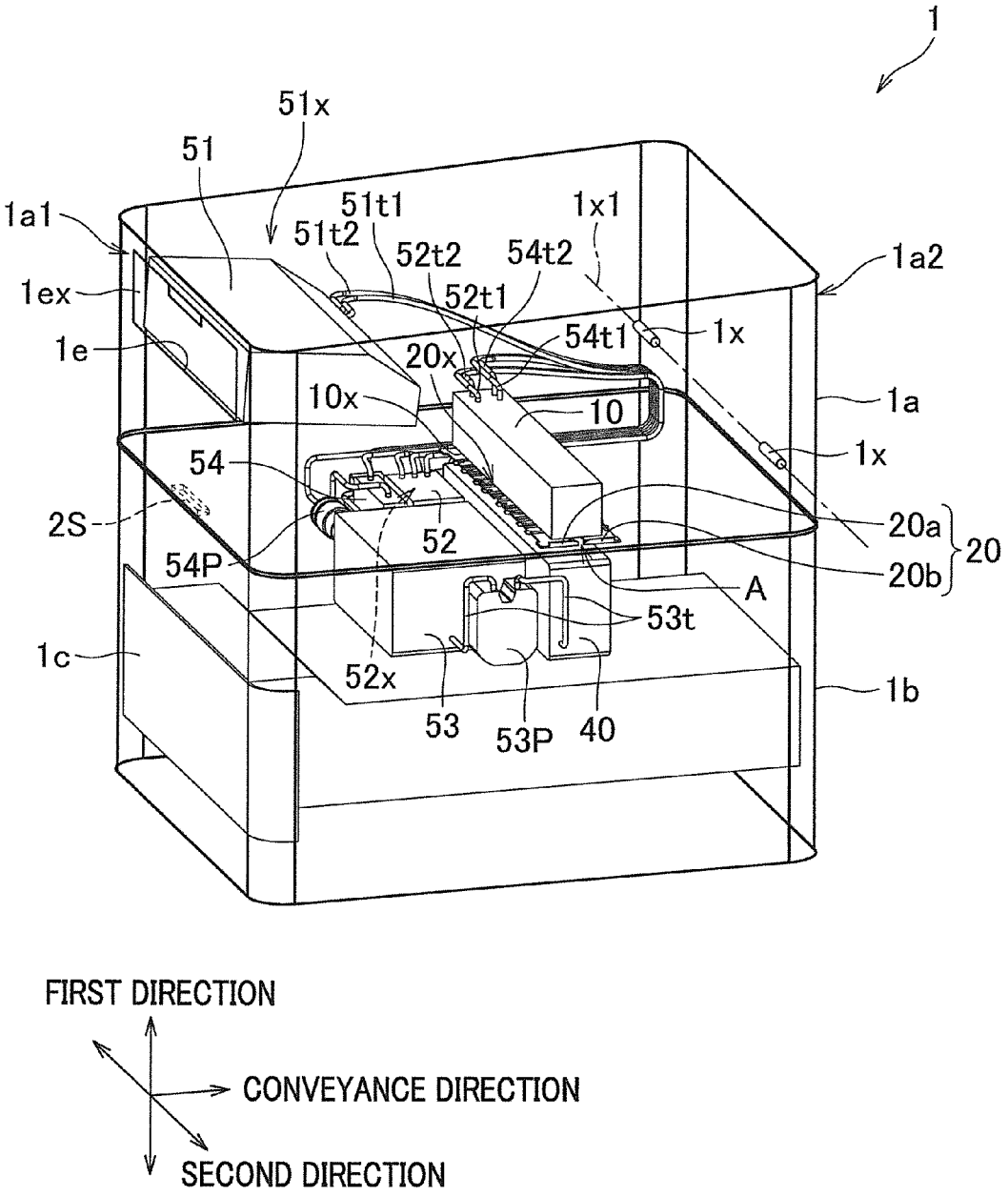
FIG. 2 is a perspective view of the inkjet printer of the first embodiment of the present invention viewed from a direction different from that of FIG. 1, illustrating the state where the first casing is in the first position.
Figure 3:
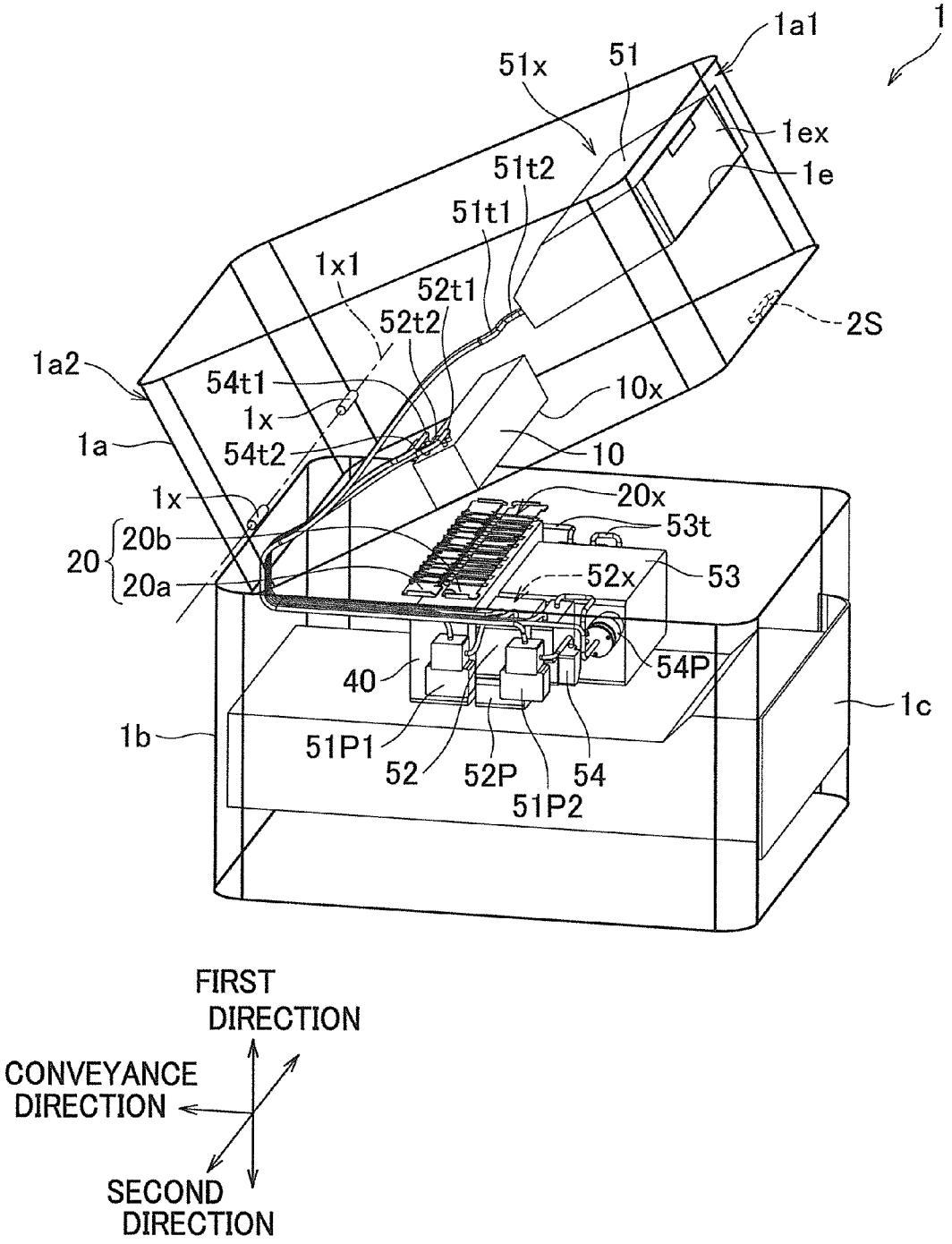
FIG. 3 is a perspective view of the inkjet printer of the first embodiment of the present invention viewed from the direction identical to that of FIG. 1, illustrating the state where the first casing is in a second position.
Figure 4:
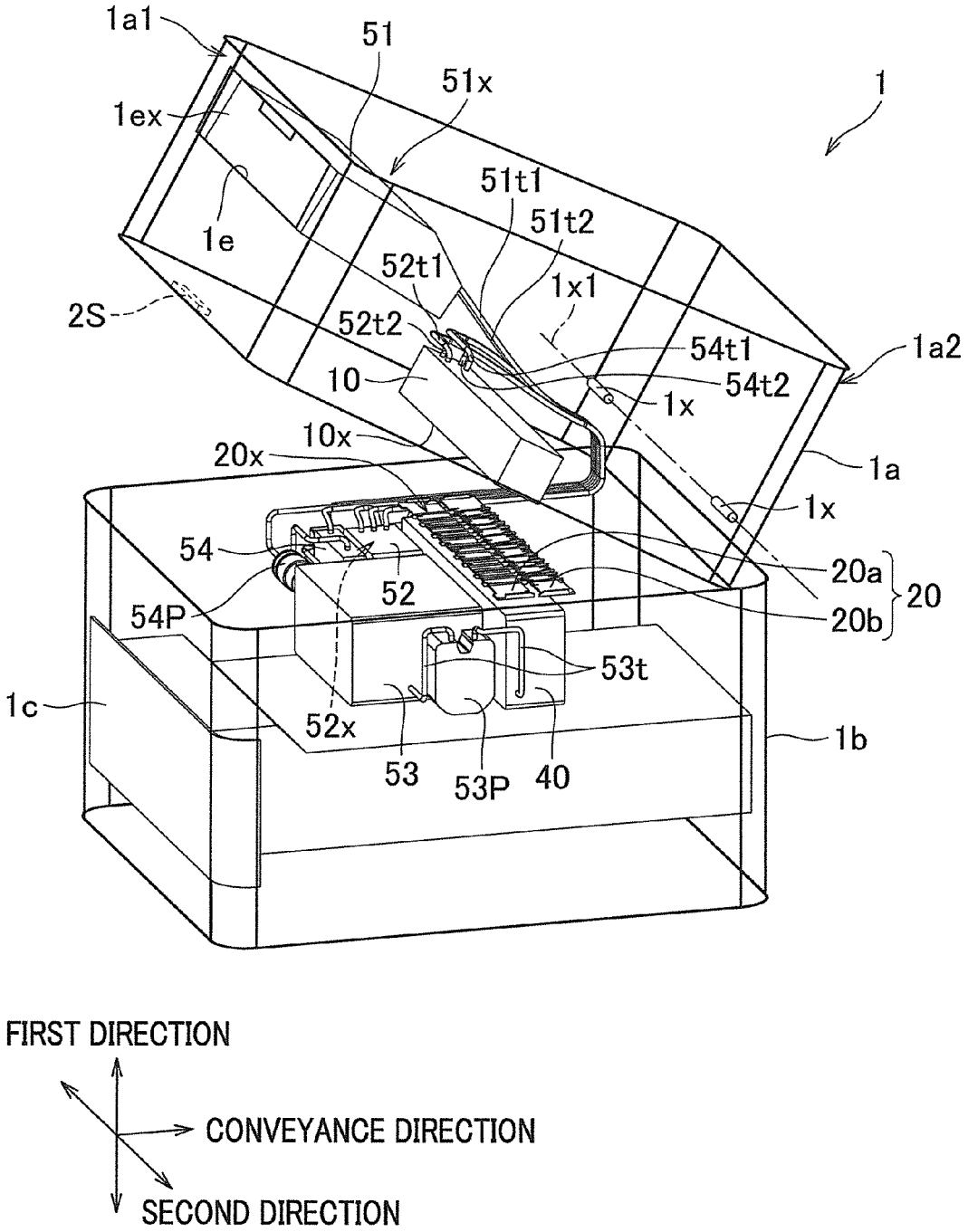
FIG. 4 is a perspective view of the inkjet printer of the first embodiment of the present invention viewed from the direction identical to that of FIG. 2, illustrating the state where the first casing is in the second position.

The communicating tube 52*t*1 extends from the portion of the sub tank 52 which is on the other side of the sub tank 52 from the opposing portion of the sub tank 52 opposing the ejected liquid tank 53 in the second direction, i.e., from the portion of the sub tank 52 which is closer to a viewer of FIG. 1. The communicating tube 53*t* extends from the portion of the ejected liquid tank 53 which is on the other side of the ejected liquid tank 53 from the opposing portion of the ejected liquid tank 53 opposing the sub tank 52 in the second direction, i.e., from the portion of the ejected liquid tank 53 which is farther from the viewer of FIG. 1. In this case, the reduction of the lengths of the both of the communicating tube 52*t*1 and the communicating tube 53*t* is further ensured, and such reduction further ensures the prevention of generation of air bubbles in each communicating tube.

The printer 1 includes: the pump 52P which is provided to the communicating tube 52*t*1, and is configured to supply ink in the sub tank 52 to the recording head 10; the pump 53P which is provided to the communicating tube 53*t*, and is configured to supply ink received by the ejected liquid receiving member 40 to the ejected liquid tank 53. In this case, because the lengths of the communicating tubes 51*t*1, 52*t*1, and 53*t* to which the pumps 51P1, 52P, and 53P are respectively provided are shorter, the load to each of the pumps 51P1, 52P, and 53P is lighter, leading to cost reduction.

The conveyance path R is formed into the S-like shape, and includes: the first curvature R1 which is convex upstream in the conveyance direction; the straight portion R3 extending in the conveyance direction; and the second curvature R2 which is convex downstream in the conveyance direction (see FIG. 5). Further, the recording head 10 is positioned along the straight portion R3, upstream of the axis 1*x*1 in the conveyance direction and downstream of the sub tank 52 in the conveyance direction. Thus, the straight portion R3 is exposed in the situation where the first casing 1*a* is in the second position. In this case, due to the formation of the conveyance path R into the S-like shape as described above, downsizing of the area of the apparatus viewed from the first direction is achieved. In addition, the jam clearing process is performed easily by moving the first casing 1*a* in the second position so that the straight portion R3 is exposed. Further, because the recording head 10 is positioned downstream of the sub tank 52 in the conveyance direction, the distance between the recording head 10 and the axis 1*x*1 is smaller than in the case where the recording head 10 is positioned upstream of the sub tank 52 in the conveyance direction.

The opening 1*e* through which the main tank 51 is received by the main tank receiving portion 51*x* is opened through the side surface out of the two side surfaces 1*a*1 and 1*a*2 of the first casing 1*a*, which surface is distant farther from the axis 1*x*1 in the conveyance direction in the situation where the first casing 1*a* is in the first position. In view of the structure of the rotation of the casing 1*a* relative to the casing 1*b*, it is convenient for a user to face the side surface 1*a*1 farther from the axis 1*x*1 of the first casing 1*a*, in the jam clearing process. The above configuration makes it possible to perform the jam clearing process and the process of attaching/detaching the main tank 51 through the same side surface, leading to good operability.

In the second casing 1*b*, the container 1*c* and a portion of the conveyance path extending from the container 1*c* to the opposing position A (the first curvature R1) are positioned (see FIG. 5). Due to this, it is difficult to secure the space for the main tank receiving portion 51*x* in the vicinity of a side surface of the second casing 1*b* which surface is positioned below the side surface 1*a*1. Thus, it is hard to adopt the arrangement in which the opening 1*e* is opened through the above-mentioned side surface of the second casing 1*b*. Meanwhile, in the first casing 1*a*, there is a dead space in the vicinity of the side surface 1*a*1, and therefore it is easier to secure the space for the main tank receiving portion 51*x*. Further, in this embodiment, the recording head 10 is positioned downstream of a horizontal portion of the conveyance path (the straight portion R3) in the conveyance direction, that is, the recording head 10 is positioned close to the axis 1*x*1 in the conveyance direction. This further ensures that the space for the main tank receiving portion 51*x* is secured in the vicinity of the side surface 1*a*1 of the first casing 1*a*.

Further, the support surface of the receiver 1*d* configured to support one or more sheets of paper P is inclined upward toward side surface 1*a*1 of the first casing 1*a* so that the end of the support surface closer to the side surface 1*a*1 of the first casing 1*a* is higher than the end of the support surface closer to the side surface 1*a*2 of the first casing 1*a*. This makes it easier for a user to access a sheet of paper P from a position close to the side surface 1*a*1 of the first casing 1*a* when the user takes the paper P received by the receiver 1*d*. Further, the side surface 1*a*1 of the first casing 1*a* has the opening through which the container 1*c* is attached/detached, and the direction in which the container 1*c* is attached/detached is parallel to the conveyance direction. This makes it easier for a user to access the printer 1 from the position close to the side surface 1*a*1 of the first casing 1*a*, when the container 1*c* is attached/detached. It can be said that it is convenient for the user to face the side surface 1*a*1 when the user takes a sheet of paper P received by the receiver 1*d*, and when the user attaches/detaches the container 1*c*.

Thus, according to this embodiment, it is possible to perform all the following processes of: the jam clearing process; the process of attaching/detaching the main tank 51; the process of taking a sheet of paper P received by the receiver 1*d*; and the process of attaching/detaching the container 1*c*, at a position close to the side surface 1*a*1. This leads to good operability.

In the situation where the first casing 1*a* is in the first position, the distance D10 between the recording head 10 and the axis 1*x*1 in the conveyance direction is smaller than the distance D51*x* between the main tank receiving portion 51*x* and the axis 1*x*1 (see FIG. 5). In this case, positioning of the recording head 10 close to the axis 1*x*1 is further ensured. Thus, the change in the head difference caused by the rotation of the first casing 1*a* is reduced, and breakage of the menisci is prevented. Further, the main tank receiving portion 51*x* is positioned in the space made available by positioning the recording head 10 closer to the axis 1*x*1. With this, the space is effectively used.

The pump 51P1 and the pump 52P are supported by the second casing 1*b*. In this case, the weight of the first casing 1*a* is smaller than in the case where at least one of the pump 51P1 and the pump 52P is supported by the first casing 1*a*, and such weight reduction decreases the load to the rotation shafts 1*x*.

Figure 10:
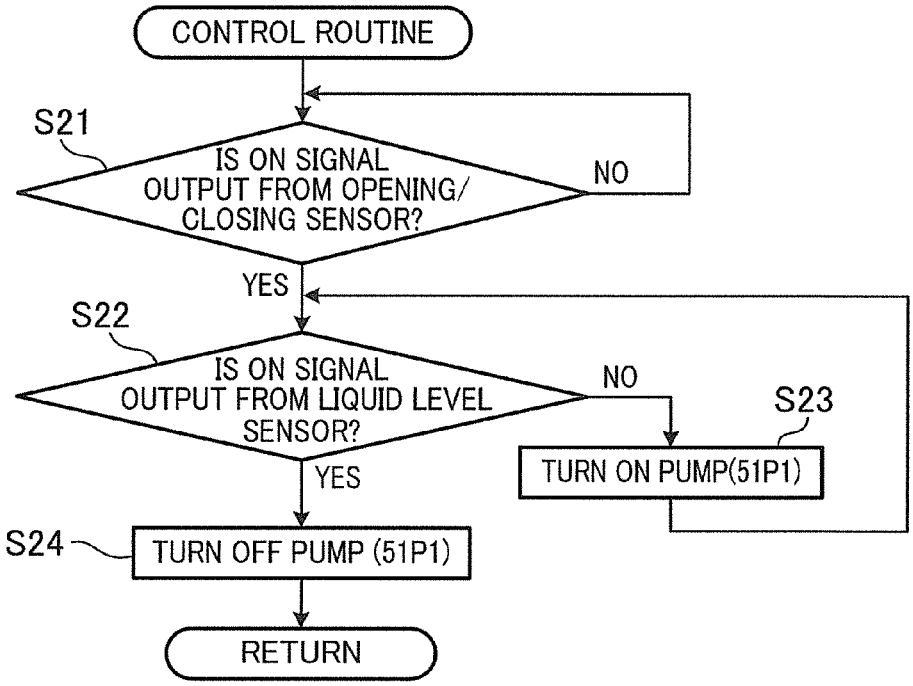
FIG. 10 is a flowchart illustrating a control routine of an inkjet printer of the second embodiment of the present invention.

The following will describe an inkjet printer of the second embodiment of the present invention with reference to FIG. 10. The printer of the second embodiment has the same configuration as that of the printer 1 of the first embodiment except that: the opening/closing sensor 2S is used as the first signal output unit, instead of the unlocking sensor 70S; and the control routine for opening/closing the casings 1*a* and 1*b* is executed using an ON signal output by the opening/closing sensor 2S as the first signal. In the second embodiment, the unlocking sensor 70S and the locking mechanism 70 may be omitted.

In the above control routine of the second embodiment, the controller 100 first determines whether the opening/closing sensor 2S outputs an ON signal, i.e., whether the movement of the first casing 1*a* from the first position to the second position is started (S21). When the controller 100 determines that the opening/closing sensor 2S does not output an ON signal (S21: NO), the controller 100 repeats the process of S21.

When the controller 100 determines that the opening/closing sensor 2S outputs an ON signal (S21: YES), the controller 100 determines whether the liquid level sensor 52S outputs an ON signal, i.e., whether the amount of ink stored in the sub tank 52 is equal to or more than the predetermined amount (S22).

When the controller 100 determines that the liquid level sensor 52S does not output an ON signal (S22: NO), the controller 100 turns on the pump 51P1 into the on-state when the pump 51P1 is in the off-state, or the controller 100 keeps the pump 51P1 in the on-state when the pump 51P1 is in the on-state (S23). With the pump 51P1 in the on-state, ink is supplied from the main tank 51 to the sub tank 52. After S23, the controller 100 returns the processing back to S22. When the controller 100 determines that the liquid level sensor 52S outputs an ON signal (S22: YES), the controller 100 turns off the pump 51P1 from the on-state to the off-state (S24). After S24, the controller 100 ends this routine.

According to the second embodiment, upon receiving an ON signal from the opening/closing sensor 2S (S21: YES), the controller 100 controls the pump 51P1 to supply ink from the main tank 51 to the sub tank 52 until the amount of ink stored in the sub tank 52 becomes equal to or more than the predetermined amount (S22 to S24). In this case, a change in the head difference caused by the movement of the first casing 1*a* is prevented or reduced, in the same way as in the first embodiment.

Further, upon receiving an ON signal from the opening/closing sensor 2S (S21: YES), the controller 100 controls the pump 51P1 to supply ink from the main tank 51 to the sub tank 52 until the controller 100 receives an ON signal from the liquid level sensor 52S (S22: YES). In this case, the control is made by using the liquid level sensor 52S, and thereby the change in the head difference caused by the movement of the first casing 1*a* is more effectively prevented or reduced, in the same way as in the first embodiment.

Figure 11:
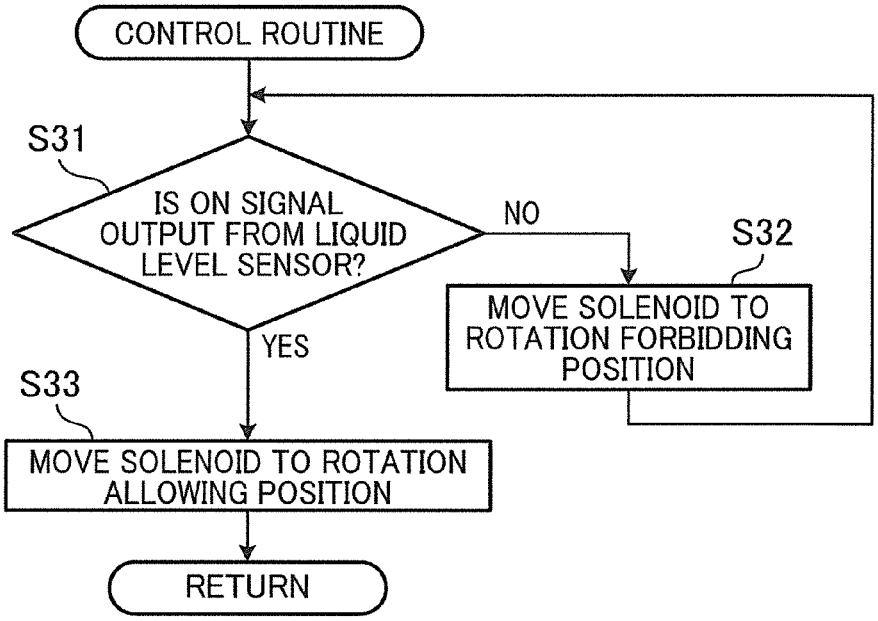
FIG. 11 is a flowchart illustrating a control routine in an inkjet printer of the third embodiment of the present invention.

The following will describe an inkjet printer of the third embodiment of the present invention with reference to FIG. 11. The printer of the third embodiment has the same configuration as that of the printer 1 of the first embodiment except that: the control routine for opening/closing the casings 1*a* and 1*b* is executed using a signal from the liquid level sensor 52S, instead of a signal from the unlocking sensor 70S or from the opening/closing sensor 2S. In the third embodiment, the unlocking sensor 70S and the opening/closing sensor 2S may be omitted.

In the above control routine of the third embodiment, the controller 100 first determines whether the liquid level sensor 52S outputs an ON signal, i.e., whether the amount of ink stored in the sub tank 52 is equal to or more than the predetermined amount (S31). When the controller 100 determines that the liquid level sensor 52S does not output an ON signal (S31: NO), the controller 100 moves the solenoid 70*a* to the rotation forbidding position when the solenoid 70*a* is in the rotation allowing position, or keeps the solenoid 70*a* in the rotation forbidding position when the solenoid 70*a* is in the rotation forbidding position (S32). After S32, the controller 100 returns the processing back to S31.

When the controller 100 determines that the liquid level sensor 52S outputs an ON signal (S31: YES), the controller 100 controls the solenoid 70*a* to take the rotation allowing position (S33). After S33, the controller 100 ends this routine.

According to the third embodiment, the controller 100 controls the locking mechanism 70 so that the movement of the first casing 1*a* from the first position to the second position is allowed only after receiving an ON signal from the liquid level sensor 52S (S31 to S33). In this case, a change in the head difference caused by the movement of the first casing 1*a* is prevented or reduced.

Figure 12:
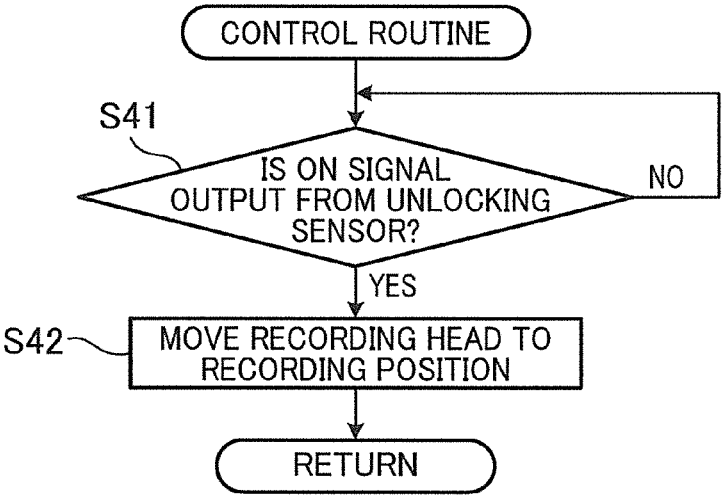
FIG. 12 is a flowchart illustrating a control routine in an inkjet printer of the fourth embodiment of the present invention.

The following will describe an inkjet printer of the fourth embodiment of the present invention with reference to FIG. 12. The printer of the fourth embodiment has the same configuration as that of the printer 1 of the first embodiment except that: in the control routine for opening/closing the casings 1*a* and 1*b*, control is made to change the position of the recording head 10 in the first direction, instead of the control to supply ink, based on a signal from the unlocking sensor 70S, so that the amount of ink stored in the sub tank 52 is equal to or more than the predetermined amount. In the fourth embodiment, the opening/closing sensor 2S and the liquid level sensor 52S may be omitted.

In the above control routine of the fourth embodiment, the controller 100 first determines whether the unlocking sensor 70S outputs an ON signal, i.e., whether a user presses the button 72*b* (S41). When the controller 100 determines that the unlocking sensor 70S does not output an ON signal (S41: NO), the controller 100 repeats the process of S41.

When the controller 100 determines that the unlocking sensor 70S outputs an ON signal (S41: YES), the controller 100 controls the head raising/lowering mechanism 11 so that the recording head 10 takes the recording position (the position indicated with the solid line in FIG. 5) (S42). After S42, the controller 100 ends this routine.

According to the fourth embodiment, upon receiving an ON signal from the unlocking sensor 70S (S41: YES), the controller 100 controls the head raising/lowering mechanism 11 so that the recording head 10 is positioned in the recording position where the distance between the ejection surface 10*x* and the opposing surface 20*x* is the smallest within the predetermined range (S42). In this case, a change in the head difference caused by the movement of the first casing 1*a* is prevented or reduced.

Figure 13:
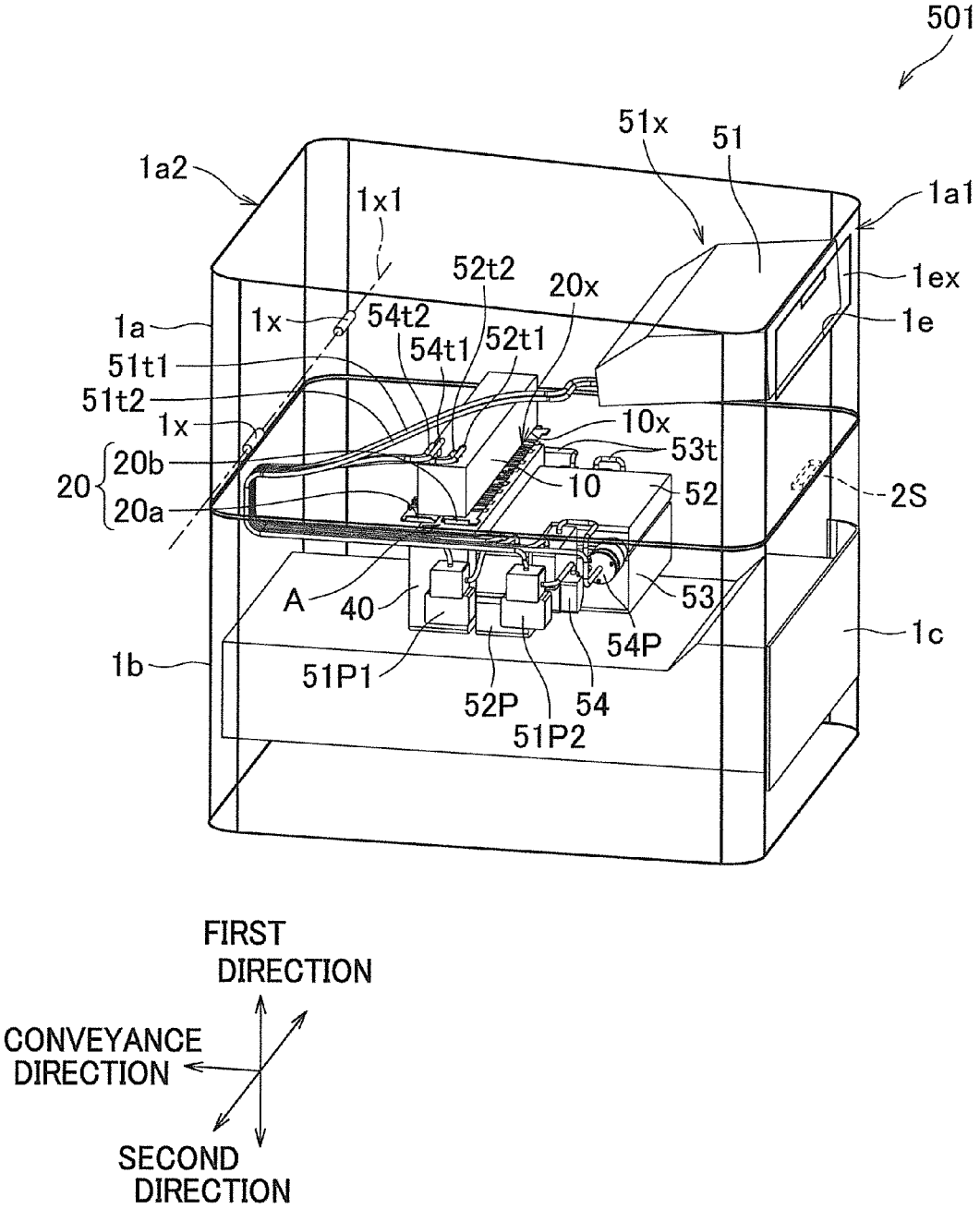
FIG. 13 is a perspective view of an inkjet printer of the fifth embodiment of the present invention, illustrating the state where the first casing is in the first position.
Figure 14:
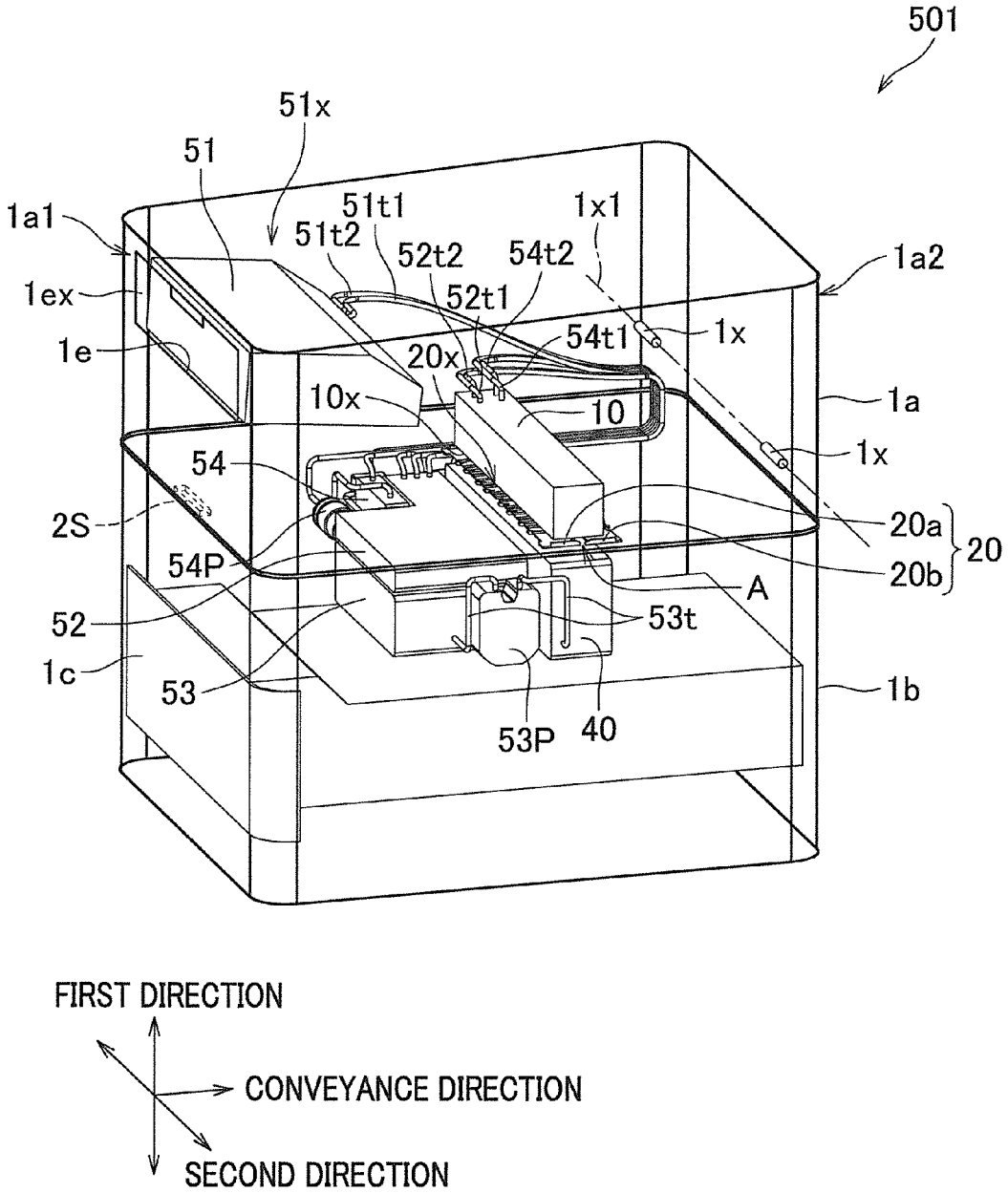
FIG. 14 is a perspective view of the inkjet printer of the fifth embodiment of the present invention viewed from a direction different from that of FIG. 13, illustrating the state where the first casing is in the first position.

The following will describe an inkjet printer 501 of the fifth embodiment of the present invention with reference to FIG. 13 and FIG. 14. The printer 501 has the same configuration as that of the printer 1 of the first embodiment, except the positions of the sub tank 52 and the ejected liquid tank 53. In the fifth embodiment, the sub tank 52 and the ejected liquid tank 53 are positioned to be aligned in the first direction, and the sub tank 52 is positioned above the ejected liquid tank 53. In this case, the head difference between the sub tank 52 and the recording head 10 is smaller, and therefore breakage of the menisci is prevented.

It should be noted that the present invention is applicable to not only a printer, but also to a facsimile machine, a photocopier, and the like.

The recording medium is not limited to a sheet of paper. The recording medium may be any type of medium such as a sheet of cloth as long as it is a recording medium in the form of a sheet and onto which recording is possible.

The number of the recording heads may be arbitrarily determined. A single recording head or a plurality of recording heads may be provided. The recording head may be configured so that a plurality of head elements respectively including ejection surfaces are arranged in a staggered manner. The recording head is not limited to a line-type head. The recording head may be a serial-type head configured to move in the second direction during recording. In the case where the recording head is the serial-type head, a projected area of a region in which the recording head is movable, projected onto the virtual plane from the first direction, corresponds to the "projected area of the recording head" in the present invention.

The conveyer may have any configuration other than that in the above-described embodiments, in which pairs of rollers are included. Examples of the other configuration include: the configuration in which a belt configured to travel while supporting a recording medium is included; and the configuration in which both of the pairs of rollers and the belt are included.

The container may be configured so as not to be attachable to/detachable from the recording apparatus.

The main tank may be attachable to/detachable from the casing of the recording apparatus, i.e., of a cartridge type, as is in the above-described embodiments. Alternatively, the main tank may be configured so as not to be attachable to/detachable from the casing of the recording apparatus, i.e., of a fixed type. Further, the main tank may store any type of liquid(s). The main tank stores two types of liquid (ink and the moisturizing liquid) in the above-described embodiments; however, the main tank may store a single or three or more type(s) of liquid.

The liquid supplier may have another configuration other than that of the above-described embodiments in which the pump is included. For example, there may be adopted the configuration in which a valve is included, or the configuration in which both of the pump and the valve are included. Either one or both of the pump 51P1 and the pump 52P may be positioned in the first casing.

Each of the container and the receiver may be supported any one of the first casing and the second casing. For example, it is possible to adopt the configuration in which the container is supported by the first casing and the receiver is supported by the second casing.

The movement of the first casing relative to the second casing is not limited to the rotation of the first casing. For example, the movement of the first casing relative to the second casing may be the movement of the first casing in the first direction. The recording apparatus does not have to include the first casing and the second casing. The recording apparatus may include a single casing.

The ejected liquid receiving member may receive liquid ejected from the ejection openings in the process other than purging. For example, the ejected liquid receiving member may receive liquid during flushing. The ejected liquid receiving member may have any shape other than the box-like shape. Further, the ejected liquid receiving member may include an absorber or the like configured to absorb the received liquid.

Instead of the wiping position, the recording head may be configured to take a retracting position where the recording head is retracted not to interfere with a wiper passing through the space opposing the ejection surface. The recording apparatus of the present invention does not have to include the head raising/lowering mechanism.

The opposing member does not have to be configured to include the two plates and to be capable of taking the opposing surface forming position and the open position. The opposing member may be configured to include a single plate and to always take the opposing surface forming position. In this configuration, liquid ejected from the ejection openings during purging and/or flushing may be received by the opposing surface formed by a surface of the single plate. The liquid received by the opposing surface may drop from sides of the opposing member, to be received by the ejected liquid receiving member, and then the liquid may be moved to the ejected liquid tank through the communicating tube. Alternatively, the liquid received by the opposing surface may be moved to the ejected liquid tank through a communicating tube attached to a side surface of the opposing member. In this case, the ejected liquid receiving member may be omitted.

In the control of the liquid supplier so that liquid is supplied from the main tank to the sub tank until the amount of liquid stored in the sub tank becomes equal to or more than the predetermined amount, the controller does not have to use a signal from the second signal output unit. For example, after calculating the amount of liquid ejected from the ejection openings (consumed amount of liquid) based on various data such as recording history data, the controller may control the liquid supplier so as to supply, to the sub tank, liquid of which amount is equivalent to the consumed amount of liquid. In the above-described embodiments, the "predetermined condition" based on which the movement of the first casing related to the first signal output unit is started is "the condition that the button 72*b* is pressed", for example. However, the predetermined condition is not limited to this. The predetermined condition may be the condition that locking by the locking mechanism is unlocked, or may be the condition that a paper jam is detected, for example. In S41 of the fourth embodiment, the controller may determine whether the opening/closing sensor 2S outputs an ON signal, instead of the unlocking sensor 70S. The controller does not have to perform the control based on a signal from each signal output unit.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a container configured to store a sheet of recording medium;

a conveyer configured to convey the recording medium contained in the container;

a main tank receiving portion configured to receive a main tank for storing liquid;

a recording head including liquid passages formed therein and an ejection surface formed thereon, leading ends of the liquid passages being openings for ejecting liquid, the ejection openings opening on the ejection surface; and a sub tank connected to the main tank and the recording head, respectively, and configured to store liquid supplied from the main tank and to supply the stored liquid therein to the liquid passages;

an ejected liquid tank configured to store liquid ejected from the recording head;

an opposing member comprising an opposing surface configured to support the recording medium in an opposing position where the recording medium opposes the ejection surface;

an ejected liquid receiving member opposing the recording head with the opposing member interposed therebetween, and configured to receive liquid ejected from the ejection openings of the recording head and to supply the liquid to the ejected liquid tank;

a first communicating tube through which the sub tank communicates with the liquid passages of the recording head;

a second communicating tube through which the ejected liquid tank communicates with the opposing member or the ejected liquid receiving member;

a first casing supporting the recording head; and a second casing supporting the opposing member, the ejected liquid receiving member, the sub tank and the ejected liquid tank, wherein:

the sub tank includes a liquid storage chamber communicable with an atmosphere;

the first casing is movable relative to the second casing so that the first casing is capable of taking a first position in which recording is performed by the recording head and a second position in which a distance between the ejection surface and the opposing surface is larger than that in the first position;

the first casing is move relative to the second casing by rotating about an axis which is along an axial direction orthogonal to a conveyance direction and parallel to the ejection surface, the conveyance direction being a direction in which the recording medium is conveyed when the recording medium conveyed by the conveyer passes through an opposing position where the recording medium opposes the ejection surface:

in a situation where the first casing is in the first position, a distance between the recording head and the axis in the conveyance direction is smaller than a distance between the sub tank and the axis in the conveyance direction, and a distance between the sub tank and the axis in the conveyance direction is equal to a distance between the ejected liquid tank and the axis in the conveyance direction; and the sub tank is aligned with the ejected liquid receiving member in the conveyance direction.

2. The recording apparatus according to claim 1, wherein each of three projected areas which are an area of the main tank receiving portion, an area of the sub tank, and an area of the recording head, each projected to a virtual plane parallel to a surface of the recording medium contained in the container from an orthogonal direction orthogonal to the virtual plane, at least partially overlaps a container projected area which is an area of the container projected to the virtual plane from the orthogonal direction.

3. The recording apparatus according to claim 2, further comprising a receiver configured to receive the recording medium after the recording medium is conveyed by the conveyer and passes through an opposing position where the recording medium opposes the ejection surface, wherein the three projected areas and the container projected area each at least partially overlaps a receiver projected area which is an area of the receiver projected to the virtual plane from the orthogonal direction.

4. The recording apparatus according to claim 3, wherein a conveyance path of the recording medium which is conveyed by the conveyer and travels from the container to the receiver via the opposing position is formed into an S-like shape, and the conveyance path includes: a first curvature which extends from the container to the opposing position and is convex upstream in the conveyance direction; and a second curvature which extends from the opposing position to the receiver and is convex downstream in the conveyance direction.

5. The recording apparatus according to claim 2, wherein a projected area of the ejected liquid tank projected to the virtual plane from the orthogonal direction at least partially overlaps the container projected area.

6. The recording apparatus according to claim 2, further comprising:

a moisturizing liquid tank configured to store moisturizing liquid for moisturizing a space opposing to the ejection surface; and a pump configured to supply air in the moisturizing liquid tank to the space opposing the ejection surface, wherein each of two projected areas which are an area of the moisturizing liquid tank and an area of the pump, each projected to the virtual plane from the orthogonal direction, at least partially overlaps the container projected area.

7. The recording apparatus according to claim 1, wherein:

the main tank receiving portion is positioned in the first casing; and the main tank receiving portion is configured to receive the main tank through an opening opened through a side surface of the first casing which surface crosses the ejection surface.

8. The recording apparatus according to claim 1, further comprising:

a first signal output unit configured to output a first signal associated with movement of the first casing from the first position to the second position;

a liquid supplier configured to supply liquid from the main tank to the sub tank; and a controller configured to receive the first signal from the first signal output unit and to control the liquid supplier, wherein upon receiving the first signal from the first signal output unit, the controller controls the liquid supplier to supply liquid from the main tank to the sub tank until the amount of liquid stored in the sub tank becomes equal to or more than a predetermined amount.

9. The recording apparatus according to claim 8, further comprising a second signal output unit configured to output a second signal indicating that the amount of liquid stored in the sub tank is equal to or more than the predetermined amount, wherein upon receiving the first signal from the first signal output unit, the controller controls the liquid supplier to supply liquid from the main tank to the sub tank until the controller receives the second signal from the second signal output unit.

10. The recording apparatus according to claim 8, further comprising a locking mechanism configured to selectively allow and forbid the movement of the first casing, wherein upon receiving, from the first signal output unit, the first signal indicating that a predetermined condition is satisfied before the movement of the first casing is started, the controller controls the locking mechanism so that the movement of the first casing is forbidden until the amount of liquid stored in the sub tank becomes equal to or more than the predetermined amount.

11. The recording apparatus according to claim 1, further comprising:

a locking mechanism configured to selectively allow and forbid movement of the first casing from the first position to the second position;

a second signal output unit configured to output a second signal indicating that the amount of liquid stored in the sub tank is equal to or more than the predetermined amount; and a controller configured to receive the second signal from the second signal output unit and to control the locking mechanism, wherein the controller controls the locking mechanism to allow the movement of the first casing on condition that the controller receives the second signal from the second signal output unit.

12. The recording apparatus according to claim 1, further comprising:

a first signal output unit configured to output a first signal associated with movement of the first casing from the first position to the second position i;

a moving mechanism configured to move the recording head, within a predetermined range, in a direction orthogonal to the ejection surface; and a controller configured to receive the first signal from the first signal output unit and to control the moving mechanism, wherein upon receiving the first signal from the first signal output unit, the controller controls the moving mechanism to position the recording head at a position where a distance between the ejection surface and the opposing surface is the smallest within the predetermined range.

13. The recording apparatus according to claim 1, wherein:

the sub tank and the ejected liquid tank are aligned in the axis direction: and each of the sub tank and the ejected liquid tank is aligned with the opposing member in the conveyance direction.

14. The recording apparatus according to claim 1, wherein:

the sub tank and the ejected liquid tank are aligned in a direction orthogonal to the conveyance direction and to the axial direction; and the sub tank is positioned above the ejected liquid tank.

15. The recording apparatus according to claim 1, wherein the recording head is a line-type head long in the axial direction.

* * * * *